US010752026B2

(12) United States Patent
Takeuchi

(10) Patent No.: US 10,752,026 B2
(45) Date of Patent: Aug. 25, 2020

(54) LIQUID JETTING APPARATUS AND METHOD OF COPING WITH FLOATING OF MEDIUM

(71) Applicant: FUJIFILM Corporation, Tokyo (JP)

(72) Inventor: Makoto Takeuchi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 16/364,190

(22) Filed: Mar. 26, 2019

(65) Prior Publication Data

US 2019/0217603 A1 Jul. 18, 2019

Related U.S. Application Data

(63) Continuation of application No. PCT/JP2017/033937, filed on Sep. 20, 2017.

(30) Foreign Application Priority Data

Sep. 27, 2016 (JP) ..... 2016-188701

(51) Int. Cl.
*B41J 11/00* (2006.01)
*B41J 25/308* (2006.01)
(Continued)

(52) U.S. Cl.
CPC ..... *B41J 11/0095* (2013.01); *B41J 11/005* (2013.01); *B41J 13/0009* (2013.01); *B41J 25/308* (2013.01)

(58) Field of Classification Search
CPC ..... B41J 25/308
See application file for complete search history.

(56) References Cited

U.S. PATENT DOCUMENTS 10,252,520 B2 4/2019 Suzuki
2016/0075154 A1 3/2016 Häcker et al.
(Continued)

FOREIGN PATENT DOCUMENTS

DE 102016208079 3/2017
EP 3170666 A1 * 5/2017 ..... B41J 25/3082
(Continued)

OTHER PUBLICATIONS

"International Search Report (Form PCT/ISA/210) of PCT/JP2017/033937," dated Dec. 5, 2017, with English translation thereof, pp. 1-5.
(Continued)

*Primary Examiner* — Shelby L Fidler
(74) *Attorney, Agent, or Firm* — JCIPRNET

(57) ABSTRACT

There are provided a liquid jetting apparatus and a method of coping with the floating of a medium where power at the time of coping with the floating of a medium can be suppressed. After the floating of a medium (36) is detected, a first movement parameter that represents the speed or acceleration of a first liquid jet head (56C) during movement is set, a second movement parameter that represents the magnitude of speed of a second liquid jet head (56M), which is smaller than the magnitude of the speed of the first liquid jet head, or a second movement parameter that represents a magnitude of acceleration of the second liquid jet head, which is smaller than the magnitude of the acceleration of the first liquid jet head, is set, an operation of the first liquid jet head is started at a first timing, and an operation of the second liquid jet head is started at the same timing as the first timing or at a second timing when the first liquid jet head does not yet reach a first retreat position.

14 Claims, 19 Drawing Sheets

(51) Int. Cl.
*B41J 13/00* (2006.01)
*B41J 25/00* (2006.01)

(56) References Cited

U.S. PATENT DOCUMENTS

| | | | | |
|---|---|---|---|---|
| 2017/0072722 | A1 | 3/2017 | Mueller et al. | |
| 2019/0299684 | A1* | 10/2019 | Takeuchi | B41J 2/01 |

FOREIGN PATENT DOCUMENTS

| | | |
|---|---|---|
| JP | 2011126131 | 6/2011 |
| JP | 2014104617 | 6/2014 |
| JP | 2015178230 | 10/2015 |
| WO | 2016009941 | 1/2016 |
| WO | 2016059995 | 4/2016 |

OTHER PUBLICATIONS

"Written Opinion of the International Searching Authority (Form PCT/ISA/237) of PCT/JP2017/033937," dated Dec. 5, 2017, with English translation thereof, pp. 1-9.
"Office Action of Japan Counterpart Application", dated Mar. 27, 2020, with English translation thereof, p. 1-p. 7.
"Search Report of Europe Counterpart Application", dated Sep. 4, 2019, p. 1-p. 10.

* cited by examiner

LIQUID JETTING APPARATUS AND METHOD OF COPING WITH FLOATING OF MEDIUM

CROSS-REFERENCE TO RELATED APPLICATIONS

The present application is a Continuation of PCT International Application No. PCT/JP2017/033937 filed on Sep. 20, 2017 claiming priority under 35 U.S.C § 119(a) to Japanese Patent Application No. 2016-188701 filed on Sep. 27, 2016. Each of the above applications is hereby expressly incorporated by reference, in their entirety, into the present application.

BACKGROUND OF THE INVENTION

1. Field of the Invention

The present invention relates to a liquid jetting apparatus and a method of coping with the floating of a medium, and more particularly, to a technique for coping with a case in which floating occurs on a medium.

2. Description of the Related Art

JP2015-178230A discloses a liquid jetting apparatus that moves liquid jet heads to retreat positions due to the occurrence of surface abnormality of a medium, transports the abnormal portion of the surface of the medium to a collision-avoidance position, and then moves the liquid jet heads to perform printing on the medium.

The liquid jetting apparatus disclosed in JP2015-178230A simultaneously moves the plurality of liquid jet heads in the movement of the liquid jet heads to the retreat positions, and moves the liquid jet heads in the order of the ink jet heads, through which the abnormal portion of the surface of the medium passes, in the movement of the liquid jet heads to print positions.

The term of "liquid jet head" in this specification corresponds to the term of "ink jet head" in JP2015-178230A. The term of "liquid jetting apparatus" in this specification corresponds to the term of "ink jet printing apparatus" in JP2015-178230A. The term of "medium" in this specification corresponds to the term of "print medium" or "continuous paper" in JP2015-178230A.

SUMMARY OF THE INVENTION

However, in a case in which the liquid jetting apparatus disclosed in JP2015-178230A is to simultaneously move the plurality of liquid jet heads to the retreat positions, actual power required for a mechanism, which moves the liquid jet head positioned on the relatively downstream side in the transport direction of a medium, becomes larger than the power originally required for the mechanism if the same speed and the same acceleration are set to the plurality of liquid jet heads. As a result, there is a concern that a motor of the mechanism for moving the liquid jet head may be increased in size and a control unit and the like may be increased in size.

The invention has been made in consideration of the above-mentioned circumstances, and an object of the invention is to provide a liquid jetting apparatus and a method of coping with the floating of a medium where power at the time of coping with the floating of a medium can be suppressed.

The following aspects of the invention are provided to achieve the above-mentioned object.

A liquid jetting apparatus of a first aspect comprises: a medium transport unit that includes a medium support surface supporting a sheet-like medium and transports the medium along a medium transport direction; a medium floating detection unit that detects floating of the medium transported by the medium transport unit; a first liquid jet head that is disposed at a position on a downstream side of the medium floating detection unit in the medium transport direction and jets liquid onto the medium transported by the medium transport unit; a second liquid jet head that is disposed at a position on a downstream side of the first liquid jet head in the medium transport direction and jets liquid onto the medium transported by the medium transport unit; a first head raising/lowering unit that moves the first liquid jet head in a direction having an upward component opposite to a direction of gravity or a direction having a component parallel to the direction of gravity; a first movement parameter setting unit that sets at least one of a first movement parameter representing a magnitude of speed of the first liquid jet head moved by the first head raising/lowering unit or a first movement parameter representing a magnitude of acceleration of the first liquid jet head moved by the first head raising/lowering unit; a first head raising/lowering control unit that controls an operation of the first head raising/lowering unit using the first movement parameter set by the first movement parameter setting unit; a second head raising/lowering unit that moves the second liquid jet head in a direction having an upward component opposite to the direction of gravity or a direction having a component parallel to the direction of gravity; a second movement parameter setting unit that sets at least one of a second movement parameter representing a magnitude of speed of the second liquid jet head moved by the second head raising/lowering unit, which is smaller than the magnitude of the speed of the first liquid jet head, or a second movement parameter representing a magnitude of acceleration of the second liquid jet head moved by the second head raising/lowering unit, which is smaller than the magnitude of the acceleration of the first liquid jet head, so as to correspond to the first movement parameter set by the first movement parameter setting unit; and a second head raising/lowering control unit that controls an operation of the second head raising/lowering unit using the second movement parameter set by the second movement parameter setting unit. The first head raising/lowering control unit starts an operation of the first head raising/lowering unit at a first timing to move the first liquid jet head to a first retreat position from a first jet position at which liquid is to be jet from the first liquid jet head, in a case in which the floating of the medium is detected by the medium floating detection unit. The second head raising/lowering control unit starts an operation of the second head raising/lowering unit at the same timing as the first timing or at a second timing, when a predetermined period has elapsed from the first timing and the first liquid jet head does not yet reach the first retreat position, to move the second liquid jet head to a second retreat position from a second jet position at which liquid is to be jet from the second liquid jet head, in a case in which the floating of the medium is detected by the medium floating detection unit.

According to the first aspect, in a case in which the floating of the medium is detected and the first and second liquid jet heads are allowed to retreat, the movement parameters are individually set for the first and second liquid jet heads. The magnitude of the speed or acceleration of the second liquid jet head is smaller than the magnitude of the speed or acceleration of the first liquid jet head.

Accordingly, power required to allow the second liquid jet head to retreat to the second retreat position from the second jet position can be set to be smaller than power required to allow the first liquid jet head to retreat to the first retreat position from the first jet position.

The terms of "first" and "second" in the first aspect mean a relative relationship between two components in a case in which two or more components are provided. The same applies to the second to fourteenth aspects.

The magnitude of the speed of the first liquid jet head may be the average value of the magnitude of the speed of the first liquid jet head in a period in which the first liquid jet head is moved, or may be the maximum value of the magnitude of the speed of the first liquid jet head in a period in which the first liquid jet head is moved.

The magnitude of the speed of the second liquid jet head may be the average value of the magnitude of the speed of the second liquid jet head in a period in which the second liquid jet head is moved, or may be the maximum value of the magnitude of the speed of the second liquid jet head in a period in which the second liquid jet head is moved.

The second movement parameter, which is set so as to correspond to the first movement parameter, is the magnitude of speed in a case in which the magnitude of speed is set as the first movement parameter, the magnitude of acceleration in a case in which the magnitude of acceleration is set as the first movement parameter, and the magnitude of speed and the magnitude of acceleration in a case in which the magnitude of speed and the magnitude of acceleration are set as the first movement parameter.

According to a second aspect, in the liquid jetting apparatus of the first aspect, the second head raising/lowering control unit may start the operation of the second head raising/lowering unit at the same timing as the first timing.

According to the second aspect, the movement of the second liquid jet head can be started at the movement start timing of the first liquid jet head. Accordingly, it is possible to further reduce the magnitude of the speed of the second liquid jet head or the magnitude of the acceleration of the second liquid jet head in a case in which the second liquid jet head is allowed to retreat to the second retreat position from the second jet position.

According to a third aspect, in the liquid jetting apparatus of the first aspect, the second head raising/lowering control unit may start the operation of the second head raising/lowering unit at the second timing when a delay period has elapsed from the first timing, and the delay period may be shorter than a period between a timing when the floating of the medium is detected by the medium floating detection unit and a timing when the medium of which the floating is detected reaches a first liquid jet region that is positioned on a transport path of the medium and is a region where liquid is to be jet from the first liquid jet head.

According to the third aspect, the movement start timing of the second liquid jet head may be later than the movement start timing of the first liquid jet head.

According to a fourth aspect, in the liquid jetting apparatus of any one aspect of the first to third aspects, the first movement parameter setting unit may set a unit period, which is divided from a period between the timing when the floating of the medium is detected by the medium floating detection unit and a timing when the medium of which the floating is detected reaches a first liquid jet region that is positioned on a transport path of the medium and is the region where liquid is to be jet from the first liquid jet head, and a moving distance of the first liquid jet head during the unit period, as the first movement parameter representing the magnitude of the speed of the first liquid jet head; and the second movement parameter setting unit may set the unit period and a moving distance of the second liquid jet head during the unit period, which is shorter than the moving distance of the first liquid jet head during the unit period, as the second movement parameter representing the magnitude of the speed of the second liquid jet head.

According to the fourth aspect, the constant-speed operations of the first and second liquid jet heads can be performed.

In the fourth aspect; it is preferable that the unit period is 1/100 or less of a period between the timing when the floating of the medium is detected and the timing when the medium of which the floating is detected reaches the liquid jet region which is positioned on the transport path of the medium and where liquid is to be jet from the first liquid jet head.

According to a fifth aspect, in the liquid jetting apparatus of any one aspect of the first to third aspects, the first movement parameter setting unit may set a unit period, which is divided from a period between the timing when the floating of the medium is detected by the medium floating detection unit and the timing when the medium of which the floating is detected reaches a first liquid jet region that is positioned on a transport path of the medium and is the region where liquid is to be jet from the first liquid jet head, and a moving distance of the first liquid jet head during the unit period, which is different for each unit period, as the first movement parameter representing the magnitude of the acceleration of the first liquid jet head; and the second movement parameter setting unit may set the unit period and a moving distance of the second liquid jet head during the unit period, which is shorter than the moving distance of the first liquid jet head during the unit period and is different for each unit period, as the second movement parameter representing the magnitude of the acceleration of the second liquid jet head.

According to the fifth aspect, the acceleration/deceleration operations of the first and second liquid jet heads can be performed.

In the fifth aspect, an operation where a deceleration period is started immediately after the end of an acceleration period may be applied as the acceleration/deceleration operation. An operation where a deceleration period is started when a constant-speed period has passed after end of an acceleration period may be applied as the acceleration/deceleration operation.

According to a sixth aspect, in the liquid jetting apparatus of the fourth or fifth aspect, the first head raising/lowering control unit may allow the first head raising/lowering unit to be operated to intermittently operate the first liquid jet head for each unit period, and the second head raising/lowering control unit may allow the second head raising/lowering unit to be operated to intermittently operate the second liquid jet head for each unit period in a non-operation period of the first liquid jet head.

According to the sixth aspect, a time-sharing operation of the first and second liquid jet heads can be performed.

According to a seventh aspect, in the liquid jetting apparatus of any one aspect of the first to sixth aspects, in a case in which the first head raising/lowering control unit allows the first head raising/lowering unit to be operated to move the first liquid jet head from the first retreat position to the first jet position that is a position where liquid is to be jet from the first liquid jet head, the first head raising/lowering control unit may start to move the first liquid jet head to the first jet position from the first retreat position at a timing earlier than a timing when the second liquid jet head starts to be moved from the second retreat position to the second jet position that is a position where liquid is to be jet from the second liquid jet head.

According to the seventh aspect, in a case in which the first liquid jet head is to be moved to the first jet position from the first retreat position and the second liquid jet head is to be moved to the second jet position from the second retreat position, the operations of the first and second liquid jet heads can be started in sequence from the first liquid jet head.

According to an eighth aspect, in the liquid jetting apparatus of any one aspect of the first to sixth aspects, in a case in which the first head raising/lowering control unit allows the first head raising/lowering unit to be operated to move the first liquid jet head from the first retreat position to the first jet position that is a position where liquid is to be jet from the first liquid jet head, the first head raising/lowering control unit may start to move the first liquid jet head to the first jet position from the first retreat position at the same timing as a timing when the second liquid jet head starts to be moved from the second retreat position to the second jet position that is a position where liquid is to be jet from the second liquid jet head.

According to the eighth aspect, in a case in which the first liquid jet head is to be moved to the first jet position from the first retreat position and the second liquid jet head is to be moved to the second jet position from the second retreat position, the operations of the first and second liquid jet heads can be started at the same time.

According to a ninth aspect, the liquid jetting apparatus of any one aspect of the first to eighth aspects may further comprise: a first preliminary jet unit that performs preliminary jet of the first liquid jet head when the first liquid jet head is moved to the first jet position from the first retreat position by the first head raising/lowering unit or after the first liquid jet head is moved to the first jet position from the first retreat position by the first head raising/lowering unit; and a second preliminary jet unit that performs preliminary jet of the second liquid jet head when the second liquid jet head is moved to the second jet position from the second retreat position by the second head raising/lowering unit or after the second liquid jet head is moved to the second jet position from the second retreat position by the second head raising/lowering unit.

According to the ninth aspect, it is possible to stabilize the meniscus shape of each of the jetting elements of the first liquid jet head having returned to the first jet position and the meniscus shape of each of the jetting elements of the second liquid jet head having returned to the second jet position.

According to a tenth aspect, in the liquid jetting apparatus of any one aspect of the first to ninth aspects, each of the first liquid jet head and the second liquid jet head may have a structure in which a plurality of jetting elements are arranged over a length equal to or longer than an entire length of the medium in a direction orthogonal to the medium transport direction.

In the tenth aspect, the first and second liquid jet heads can employ a structure in which a plurality of head modules are arranged in a direction orthogonal to the medium transport direction.

According to an eleventh aspect, in the liquid jetting apparatus of any one aspect of the first to tenth aspects, the first liquid jet head may jet ink of which a color is different from a color of ink to be jet from the second liquid jet head.

In the eleventh aspect, the liquid jetting apparatus may comprise a third liquid jet head that is provided at a position on the downstream side of the second liquid jet head in the medium transport direction and may further comprise a fourth liquid jet head that is provided at a position on the downstream side of the third liquid jet head in the medium transport direction, and each of the first, second, third, and fourth liquid jet heads can employ a structure that jets any one of a cyan ink, a magenta ink, a yellow ink, and a black ink.

According to a twelfth aspect, in the liquid jetting apparatus of any one aspect of the first to eleventh aspects, each of the first retreat position and the second retreat position may have a distance from the medium support surface that exceeds a maximum value of a length of the medium, of which the floating is detected by the medium floating detection unit, from the medium support surface.

According to the twelfth aspect, since the first liquid jet head is allowed to retreat to the first retreat position, the contact between the first liquid jet head and the medium of which the floating is detected can be avoided.

According to a thirteenth aspect, in the liquid jetting apparatus of any one aspect of the first to twelfth aspects, the second retreat position may have a distance from the medium support surface that is the same as a distance between the first retreat position and the medium support surface.

According to the thirteenth aspect, the structure of the first head raising/lowering unit and the structure of the second head raising/lowering unit can be shared.

A method of coping with floating of a medium of a fourteenth aspect is a method of coping with floating of a medium for a liquid jetting apparatus that includes a first liquid jet head jetting liquid to a sheet-like medium transported along a medium transport direction and a second liquid jet head disposed at a position on a downstream side of the first liquid jet head in the medium transport direction. The method comprises: a medium floating detection step of detecting floating of the sheet-like medium that is supported by a medium support surface and transported along the medium transport direction; a first movement parameter-setting step of setting at least one of a first movement parameter that represents a magnitude of speed of the first liquid jet head moved in a direction having an upward component opposite to a direction of gravity or a first movement parameter that represents a magnitude of acceleration of the first liquid jet head moved in the direction having the upward component opposite to the direction of gravity after the floating of the medium is detected in the medium floating detection step; a second movement parameter-setting step of setting at least one of a second movement parameter that represents a magnitude of speed of the second liquid jet head in the direction having the upward component opposite to the direction of gravity, which is smaller than the magnitude of the speed of the first liquid jet head, or a second movement parameter that represents a magnitude of acceleration of the second liquid jet head moved in the direction having the upward component opposite to the direction of gravity, which is smaller than the magnitude of the acceleration of the first liquid jet head, so as to correspond to the first movement parameter set in the first movement parameter-setting step after the floating of the medium is detected in the medium floating detection step; a first head moving step of starting an operation of the first liquid jet head at a first timing on the basis of the first movement parameter, which is set in the first movement parameter-setting step, to move the first liquid jet head to a first retreat position from a first jet position at which liquid is to be jet from the first liquid jet head, in a case in which the floating of the medium is detected in the medium floating detection step; and a second head moving step of starting an operation of the second liquid jet head at the same timing as the first timing or at a second timing, when a predetermined period has elapsed from the first timing and the first liquid jet head does not yet reach the first retreat position, on the basis of the second movement parameter, which is set in the second movement parameter-setting step, to move the second liquid jet head to a second retreat position from a second jet position at which liquid is to be jet from the second liquid jet head, in a case in which the floating of the medium is detected in the medium floating detection step.

According to the fourteenth aspect, the same effects as the first aspect can be obtained.

In the fourteenth aspect, the same items as the items specified in the second to thirteenth aspects can be appropriately combined. In this case, components, which performs processing or functions specified in the liquid jetting apparatus, can be grasped as components, which performs processing or functions corresponding to the processing or functions, of the method of coping with the floating of a medium.

According to the invention, in a case in which the floating of the medium is detected and the first and second liquid jet heads are allowed to retreat, the movement parameters are individually set for the first and second liquid jet heads. The magnitude of the speed or acceleration of the second liquid jet head is smaller than the magnitude of the speed or acceleration of the first liquid jet head.

Accordingly, power required to allow the second liquid jet head to retreat to the second retreat position from the second jet position can be set to be smaller than power required to allow the first liquid jet head to retreat to the first retreat position from the first jet position.

DESCRIPTION OF THE PREFERRED EMBODIMENTS

Figure 1:
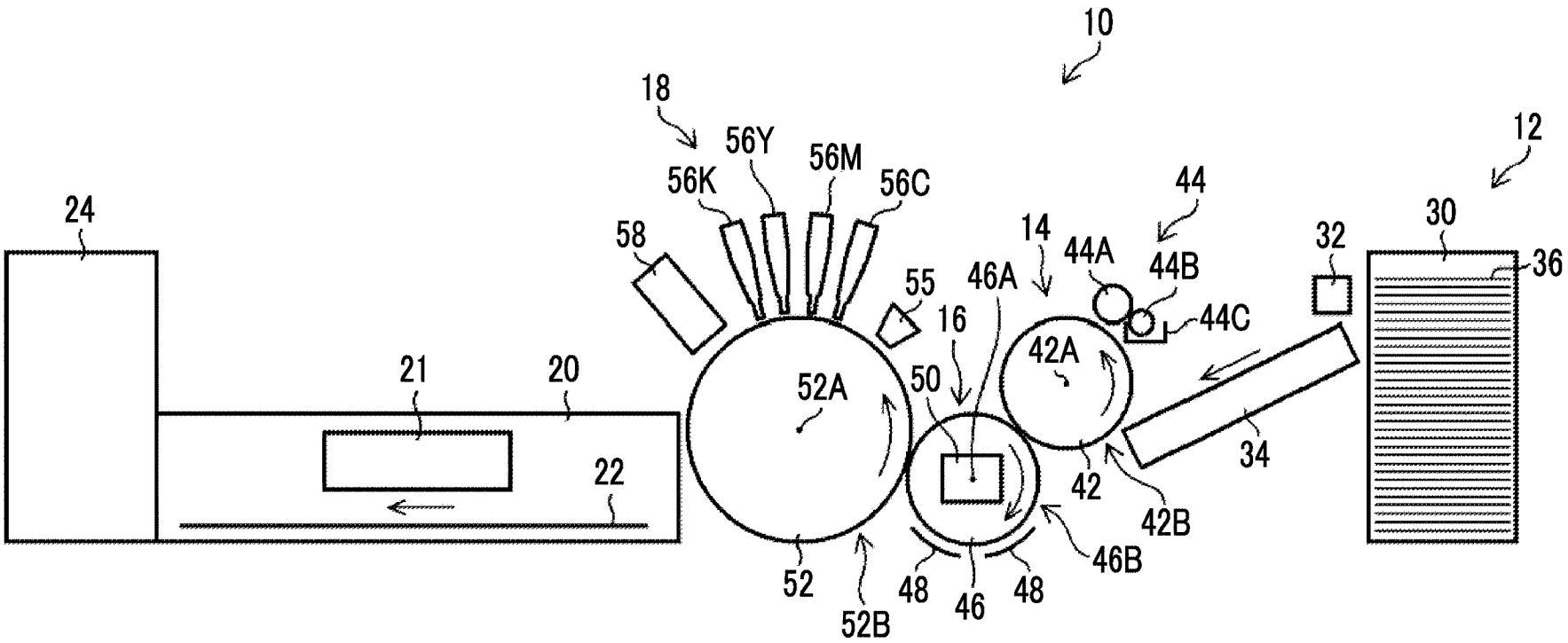
FIG. 1 is a diagram showing the schematic configuration of the entire ink jet recording apparatus.

Preferred embodiments of the invention will be described in detail below with reference to the accompanying drawings. In embodiments to be described below, the same components will be denoted by the same reference numerals and the repeated description thereof will be omitted.

[Description of Ink Jet Recording Apparatus]

<Overall Configuration>

FIG. 1 is a diagram showing the schematic configuration of the entire ink jet recording apparatus. The ink jet recording apparatus 10 shown in FIG. 1 is an image forming apparatus that applies an ink jet system to perform drawing on a sheet-like medium.

The sheet-like medium is a material on which drawing can be performed or a pattern can be formed using an ink jet system, such as sheet-like paper, a sheet-like fiber, a sheet-like metal material, or a sheet-like resin material. Hereinafter, the term of "medium" can be substituted with the term of "sheet". Further, the term of "image forming" can be substituted with the term of "drawing".

The ink jet recording apparatus 10 shown in FIG. 1 comprises a sheet feed unit 12, a treatment liquid-application section 14, a treatment liquid-drying processing section 16, a drawing unit 18, an ink-drying processing section 20, and a sheet discharge unit 24.

Further, the ink jet recording apparatus 10 comprises a head maintenance section that is not shown in FIG. 1. The head maintenance section is denoted in FIG. 8 by reference numeral 127.

The sheet feed unit 12, the treatment liquid-application section 14, the treatment liquid-drying processing section 16, the drawing unit 18, the ink-drying processing section 20, and the sheet discharge unit 24 are arranged along a sheet transport direction, which is the transport direction of a sheet 36, in the order of the sheet feed unit 12, the treatment liquid-application section 14, the treatment liquid-drying processing section 16, the drawing unit 18, the ink-drying processing section 20, and the sheet discharge unit 24.

Next, the structure of each part of the ink jet recording apparatus 10 will be described in detail. The ink jet recording apparatus 10 of this embodiment is one aspect of a liquid jetting apparatus. Ink is one aspect of liquid. The sheet transport direction corresponds to a medium transport direction.

<Sheet Feed Unit>

The sheet feed unit 12 shown in FIG. 1 comprises a stocker 30, a sheet feed sensor 32, and a feeder board 34. Sheets 36 are stored in the stocker 30. The sheet feed sensor 32 detects the sheet 36 taken out from the stocker 30.

An optical sensor can be applied as the sheet feed sensor 32, and examples of the optical sensor include a light projection type passage sensor that comprises a light projecting part and a light receiving part. Information on a sheet 36, which is acquired using the sheet feed sensor 32, is sent to a system controller 100 shown in FIG. 9. The sheet feed sensor 32 is not shown in FIG. 9.

Further, in a case in which a plurality of sheets 36 are successively fed, information on a sheet 36, which is acquired using the sheet feed sensor 32, can be applied to the detection of the feed timing of each sheet 36.

The feeder board 34 corrects the posture of a sheet 36 that is taken out from the stocker 30. The sheet 36 of which the posture is corrected by the feeder board 34 is delivered to the treatment liquid-application section 14. An arrow line, which is shown above the feeder board 34, indicates the sheet transport direction on the feeder board 34.

A sheet, which uses a material other than paper, such as sheet-like metal or a sheet-like resin, may be applied instead of a sheet 36. The medium is a concept that includes a base material or a substrate. The sheet 36 described in this embodiment is one aspect of a medium.

<Treatment Liquid-Application Section>

The treatment liquid-application section 14 shown in FIG. 1 comprises a treatment liquid drum 42 and a treatment liquid-application device 44. The treatment liquid drum 42 has a columnar shape. The treatment liquid drum 42 is supported so as to be rotatable about a columnar central shaft as a rotating shaft 42A.

The entire length of the treatment liquid drum 42 in a direction parallel to the rotating shaft 42A corresponds to the maximum width of a sheet 36 having the maximum size. The width of a sheet 36 is the length of the sheet 36 in a direction orthogonal to the sheet transport direction. A direction parallel to the rotating shaft 42A of the treatment liquid drum 42 in FIG. 1 is a direction perpendicular to the plane of FIG. 1.

The term of "orthogonal" or "perpendicular" in this specification includes "substantially orthogonal" or "substantially perpendicular" where the same effects as the effects, which are obtained in a case in which two directions cross each other at an angle of 90°, are obtained in a case in which two directions cross each other at an angle exceeding 90° or a case in which two directions cross each other at an angle less than 90°.

Further, the term of "parallel" in this specification includes "substantially parallel" where two directions are not parallel to each other but the same effects as the effects, which are obtained in a case in which the two directions are parallel to each other, are obtained. Furthermore, the term of "the same" in this specification includes "substantially the same" where components are different from each other but the same effects as the effects, which are obtained in a case in which the components are the same, are obtained.

The treatment liquid drum 42 comprises a gripper (not shown). The gripper comprises a plurality of claws. The plurality of claws are arranged along the direction parallel to the rotating shaft 42A of the treatment liquid drum 42. The plurality of claws grips the front end portion of a sheet 36. The sheet 36 of which the front end portion is gripped by the gripper is supported on an outer peripheral surface 42B of the treatment liquid drum 42. The sheet 36, which is supported on the outer peripheral surface 42B of the treatment liquid drum 42, is not shown.

Since the treatment liquid drum 42 is rotated while supporting the sheet 36 on the outer peripheral surface 42B, the treatment liquid drum 42 transports the sheet 36 along the outer peripheral surface 42B. An arrow line, which is shown in the treatment liquid drum 42, indicates the sheet transport direction in the treatment liquid-application section 14.

The treatment liquid-application device 44 comprises an application roller 44A, a measurement roller 44B, and a treatment liquid container 44C. The application roller 44A is in contact with the sheet 36, which is transported by the treatment liquid drum 42, and applies treatment liquid, which is retained on the outer peripheral surface 42B of the treatment liquid drum 42, to the sheet 36.

The measurement roller 44B draws up treatment liquid, which is stored in the treatment liquid container 44C and aggregates or insolubilizes ink, by a predetermined volume, and supplies the treatment liquid to the application roller 44A. The sheet 36 to which the treatment liquid is applied by the treatment liquid-application section 14, is delivered to the treatment liquid-drying processing section 16.

The treatment liquid-application device 44 shown in FIG. 1 performs an operation for applying treatment liquid during a period in which the sheet 36 passes through a processing region. Further, during a period in which the sheet 36 does not pass through the processing region, the treatment liquid-application device 44 is in a standby state without performing an operation for applying treatment liquid.

<Treatment Liquid-Drying Processing Section>

The treatment liquid-drying processing section 16 shown in FIG. 1 comprises a treatment liquid-drying processing drum 46, transport guides 48, and a treatment liquid-drying processing device 50. The treatment liquid-drying processing drum 46 has a columnar shape. The treatment liquid-drying processing drum 46 is supported so as to be rotatable about a columnar central shaft as a rotating shaft 46A. A direction parallel to the rotating shaft 46A of the treatment liquid-drying processing drum 46 in FIG. 1 is a direction perpendicular to the plane of FIG. 1.

The treatment liquid-drying processing drum 46 comprises a gripper that has the same structure as the gripper of the treatment liquid drum 42. The gripper of the treatment liquid-drying processing drum 46 is not shown. The gripper of the treatment liquid-drying processing drum 46 grips the front end portion of the sheet 36.

Since the treatment liquid-drying processing drum 46 is rotated while gripping the front end portion of the sheet 36 by the gripper, the treatment liquid-drying processing drum 46 transports the sheet 36 along an outer peripheral surface 46B thereof. An arrow line, which is shown in the treatment liquid-drying processing drum 46, indicates the sheet transport direction in the treatment liquid-drying processing section 16.

The sheet 36, which is transported by the treatment liquid-drying processing drum 46, passes under the treatment liquid-drying processing drum 46. The term of "lower"

in this specification indicates the direction of gravity. Further, the term of "upper" indicates a direction opposite to the direction of gravity.

The transport guides 48 are disposed at positions below the treatment liquid-drying processing drum 46. The transport guides 48 support the sheet 36 that passes under the treatment liquid-drying processing drum 46.

The treatment liquid-drying processing device 50 is disposed in the treatment liquid-drying processing drum 46. The treatment liquid-drying processing device 50 performs processing for drying treatment liquid on the sheet 36 that passes under the treatment liquid-drying processing drum 46 and that is supported by the transport guides 48.

The sheet 36, which has passed through the processing region of the treatment liquid-drying processing device 50, is delivered to the drawing unit 18. The sheet 36, which has been subjected to the processing for drying treatment liquid by the treatment liquid-drying processing device 50, is not shown in FIG. 1.

<Drawing Unit>

The drawing unit 18 shown in FIG. 1 comprises a drawing drum 52. The drawing drum 52 has a columnar shape. The drawing drum 52 is supported so as to be rotatable about a columnar central shaft as a rotating shaft 52A. A direction parallel to the rotating shaft 52A of the drawing drum 52 in FIG. 1 is a direction perpendicular to the plane of FIG. 1.

The drawing drum 52 includes a plurality of suction holes on an outer peripheral surface 52B thereof. The plurality of suction holes are connected to a suction flow passage formed in the drawing drum 52. The plurality of suction holes and the suction flow passage formed in the drawing drum 52 are not shown.

The suction flow passage formed in the drawing drum 52 is connected to a suction pressure generating device (not shown) through a pipe (not shown). In a case in which the suction pressure generating device is operated, the drawing drum 52 can generate suction pressure in the plurality of suction holes provided on the outer peripheral surface 52B.

The drawing drum 52 comprises grippers not shown in FIG. 1. Each of the grippers is denoted in FIG. 10 by reference numeral 52C. Since the structure of the gripper of the drawing drum 52 is the same as the structure of the gripper of the treatment liquid drum 42 and the structure of the gripper of the treatment liquid-drying processing drum 46, the description of the gripper will be omitted.

The grippers of the drawing drum 52 are disposed in recessed portions that are formed on the outer peripheral surface 52B of the drawing drum 52. The recessed portions formed on the outer peripheral surface 52B of the drawing drum 52 are not shown in FIG. 1. Each of the recessed portions is denoted in FIG. 10 by reference numeral 52D.

Suction pressure, which is generated in the plurality of suction holes provided on the outer peripheral surface 52B of the drawing drum 52, acts on the sheet 36 of which the front end portion is gripped by the gripper of the drawing drum 52, so that the sheet 36 is closely attached to the outer peripheral surface 52B of the drawing drum 52. The sheet 36, which is closely attached to the outer peripheral surface 52B of the drawing drum 52, is not shown in FIG. 1.

Since the drawing drum 52 is rotated while the sheet 36 is closely attached to the outer peripheral surface 52B, the drawing drum 52 transports the sheet 36 along the outer peripheral surface 52B. An arrow line, which is shown in the drawing drum 52, indicates the sheet transport direction in the drawing unit 18.

The drawing unit 18 shown in FIG. 1 comprises a sheet floating sensor 55. The sheet floating sensor 55 detects the floating of a sheet 36 that is delivered to the drawing unit 18. The floating of a sheet 36 includes a state in which at least a part of the sheet 36 is away from a sheet support surface, which is the outer peripheral surface 52B of the drawing unit 18, by a distance equal to or larger than a predetermined distance due to the bending of a corner portion of the sheet 36, the curvature of the sheet 36, or the like.

The sheet floating sensor 55 is disposed at a position on the upstream side of a liquid jet head 56C that is disposed at the most upstream position in the drawing unit 18 in the sheet transport direction. The sheet floating sensor 55 detects the floating of a sheet 36 that does not yet enter the liquid jet region of the liquid jet head 56C.

Here, the liquid jet region of the liquid jet head 56C is a region in which ink droplets jetted from the liquid jet head 56C land, and is a region positioned on the transport path of the sheet 36. The liquid jet region may be a region where the liquid jet surface of the liquid jet head 56C is projected onto the transport path of the sheet 36.

The liquid jet region of the liquid jet head 56C is not shown in FIG. 1. The liquid jet region of the liquid jet head 56C is denoted FIG. 10 by reference numeral 57C. Further, the reference numeral of the liquid jet surface is not shown. The liquid jet surface is denoted in FIG. 3 by reference numeral 277.

The drawing unit 18 shown in FIG. 1 comprises a liquid jet head 56C, a liquid jet head 56M, a liquid jet head 56Y, and a liquid jet head 56K. Each of the liquid jet heads 56C, 56M, 56Y, and 56K comprises nozzle portions that jet liquid. The nozzle portion is not shown in FIG. 1. The nozzle portion is denoted in FIG. 5 by reference numeral 281.

Here, an alphabet, which is added to the reference numeral of the liquid jet head, represents a color. C represents cyan. M represents magenta. Y represents yellow. K represents black.

The liquid jet heads 56C, 56M, 56Y and 56K are arranged at positions above the drawing drum 52. The liquid jet heads 56C, 56M, 56Y, and 56K are arranged along the sheet transport direction from the upstream side in the sheet transport direction in the order of the liquid jet heads 56C, 56M, 56Y, and 56K.

An ink jet system can be applied to each of the liquid jet heads 56C, 56M, 56Y, and 56K. The liquid jet heads 56C, 56M, 56Y, and 56K jet liquid onto a first surface of the sheet 36 that is transported by the drawing drum 52. Jetted liquid is applied to the first surface of the sheet 36, so that drawing is realized. The first surface of the sheet 36 is a surface of the sheet 36 that is opposite to the second surface of the sheet 36 supported by the drawing drum 52.

The reference numeral of the first surface of the sheet 36 and the reference numeral of the second surface of the sheet 36 are not shown. The first surface of the sheet 36 is denoted in FIG. 10 by reference numeral 36A. The first surface of the sheet 36 is called a surface, a drawing surface, or the like. The second surface of the sheet 36 is called a back surface, a surface to be supported, or the like.

The liquid jet heads 56C, 56M, 56Y, and 56K are mounted on head raising/lowering units and horizontal head moving units. The head raising/lowering units and the horizontal head moving units are not shown in FIG. 1.

Figure 6:
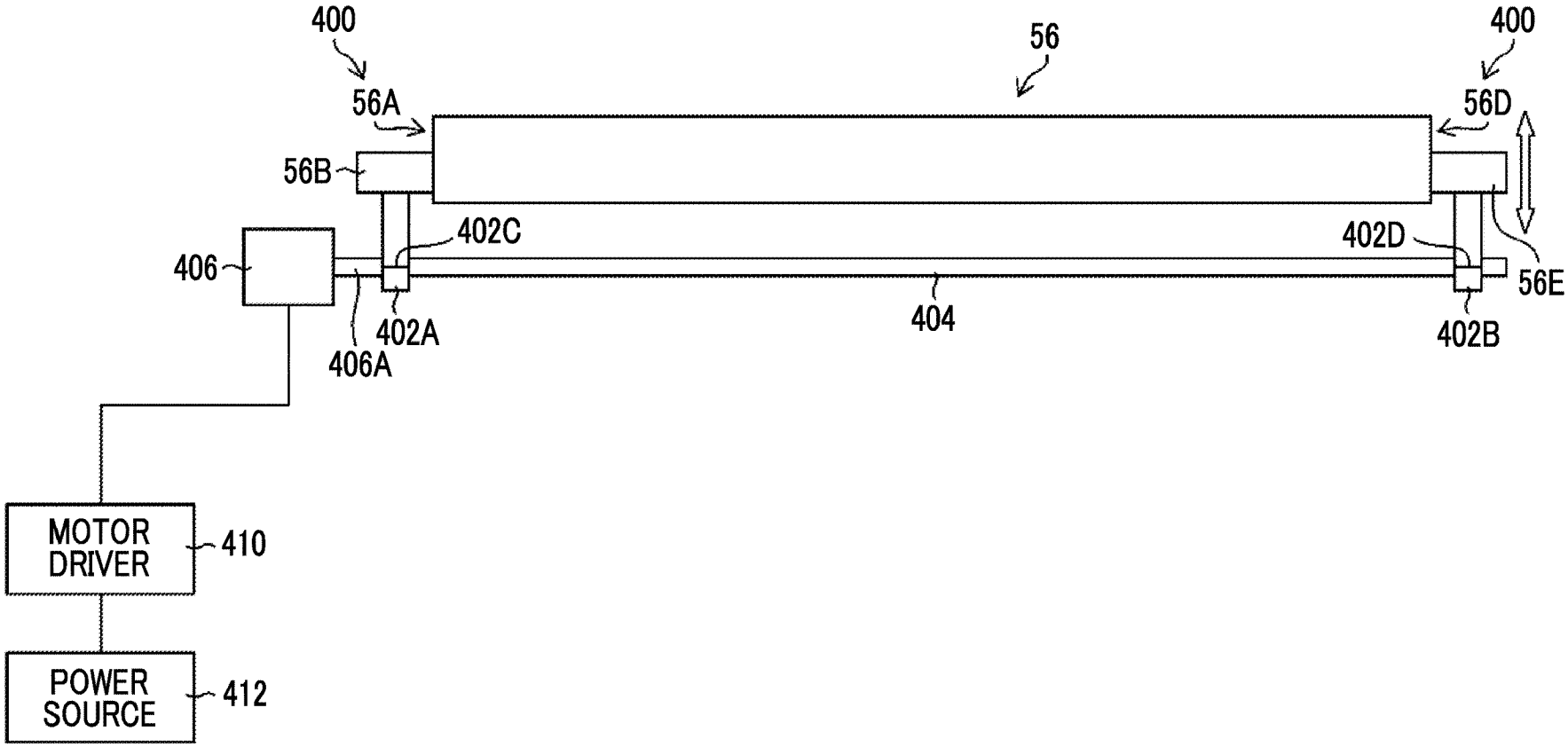
FIG. 6 is a schematic diagram showing the schematic configuration of a head raising/lowering unit.

The head raising/lowering unit is denoted in FIG. 6 by reference numeral 400. The horizontal head moving unit is denoted in FIG. 8 by reference numeral 500. The details of the head raising/lowering unit and the horizontal head moving unit will be described later.

The drawing unit 18 shown in FIG. 1 comprises an in-line sensor 58. The in-line sensor 58 is disposed at a position on the downstream side of the liquid jet head 56K that is disposed at the most downstream position in the sheet transport direction. The in-line sensor 58 comprises an imaging element, a peripheral circuit of the imaging element, and a light source.

The imaging element, the peripheral circuit of the imaging element, and the light source are not shown. A solid-state imaging element, such as a CCD image sensor or a CMOS image sensor, can be applied as the imaging element. CCD is an abbreviation for Charge Coupled Device. CMOS is an abbreviation for Complementary Metal-Oxide Semiconductor.

The peripheral circuit of the imaging element comprises a processing circuit for an output signal of the imaging element. Examples of the processing circuit include a filter circuit that removes noise components from the output signal of the imaging element, an amplifier circuit, a waveform shaping circuit, and the like. The filter circuit, the amplifier circuit, or the waveform shaping circuit is not shown.

The light source is disposed at a position where the light source can irradiate an object, which is to be read by the in-line sensor 58, with illumination light. An LED, a lamp, or the like can be applied as the light source. LED is an abbreviation for light emitting diode.

Figure 9:
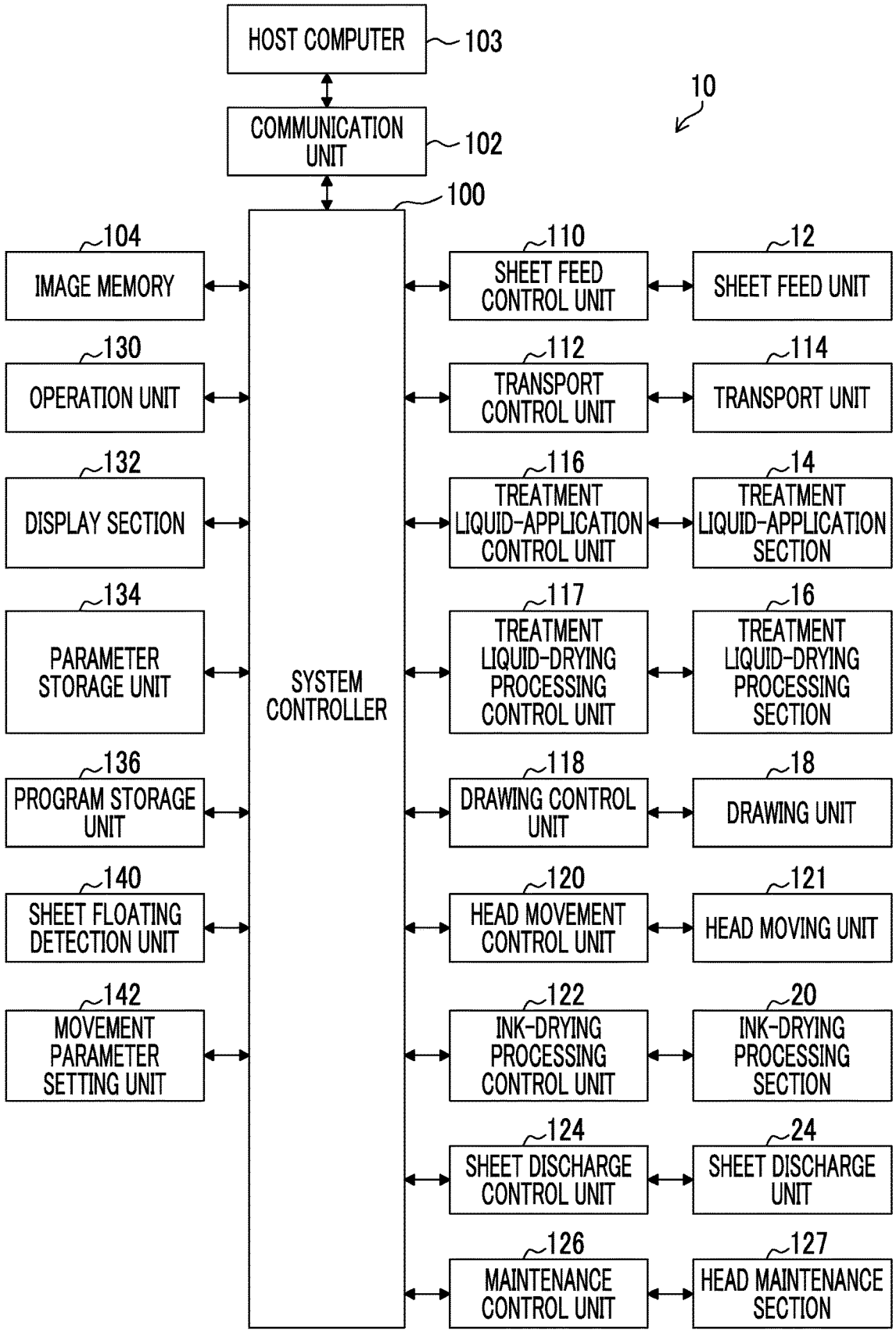
FIG. 9 is a block diagram showing the schematic configuration of a control system.

An imaging signal, which is output from the in-line sensor 58, is sent to the system controller 100 shown in FIG. 9. An imaging signal, which is output from the in-line sensor 58, can be used for the detection of abnormalities of the liquid jet heads 56C, 56M, 56Y, and 56K, the detection of density unevenness, and the like. The sheet 36 subjected to drawing in the drawing unit 18 is delivered to the ink-drying processing section 20. The sheet 36 subjected to drawing in the drawing unit 18 is not shown.

<Ink-Drying Processing Section>

The ink-drying processing section 20 shown in FIG. 1 comprises a drying processing device 21 and a sheet transport member 22. The drying processing device 21 is disposed at a position above the sheet transport member 22 that transports a sheet in the ink-drying processing section 20.

The drying processing device 21 performs drying processing on the sheet 36 to which ink is made to adhere by the drawing unit 18 and which is transported by the sheet transport member 22. A heater that radiates heat or a fan that generates wind can be applied as the drying processing device 21. The drying processing device 21 may comprise both a heater and a fan. An infrared heater, an ultraviolet lamp, or the like can be applied as the heater.

The sheet transport member 22 transports the sheet 36 in the ink-drying processing section 20. A chain transport, a belt transport, a roller transport, or the like can be applied as the sheet transport member 22. The sheet 36, which has been subjected to drying processing by the drying processing device 21, is delivered to the sheet discharge unit 24. The sheet 36, which is subjected to the processing for drying ink by the ink-drying processing section 20, is not shown in FIG. 1.

<Sheet Discharge Unit>

The sheet 36, which has been subjected to drying processing by the ink-drying processing section 20, is stored in the sheet discharge unit 24 shown in FIG. 1. The sheet 36, which is stored in the sheet discharge unit 24, is not shown. The sheet discharge unit 24 classifies a sheet 36 that has been subjected to normal drawing and a sheet 36 that is a waste sheet, and may separately store the sheet 36 that has been subjected to normal drawing and the waste sheet.

The ink jet recording apparatus 10, which comprises the treatment liquid-application section 14 and the treatment liquid-drying processing section 16, is shown in FIG. 1, but the treatment liquid-application section 14 and the treatment liquid-drying processing section 16 may be omitted. Further, in FIG. 1, a structure, such as a structure for transporting a sheet by a belt or a structure for transporting a sheet by a transport drum, may be applied as a structure that transports a sheet 36 subjected to drawing.

[Structure of Liquid Jet Head]

Next, the structures of the liquid jet heads shown in FIG. 1 will be described in detail.

<Overall Structure>

Figure 2:
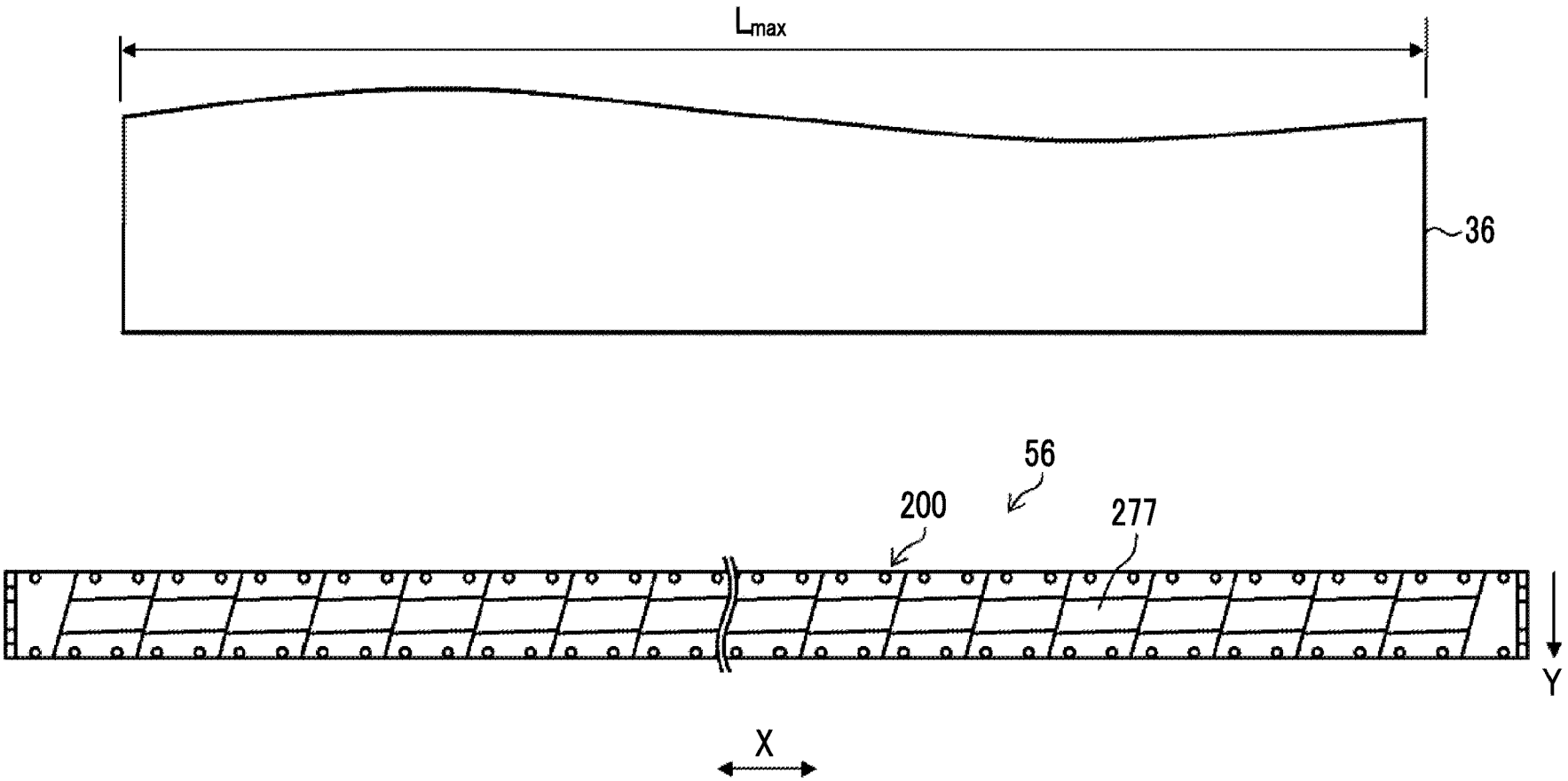
FIG. 2 is a perspective plan view of the liquid jet surface of a liquid jet head.

FIG. 2 is a perspective plan view of the liquid jet surface of the liquid jet head. The same structure can be applied to the liquid jet head 56C for jetting a cyan ink, the liquid jet head 56M for jetting a magenta ink, the liquid jet head 56Y for jetting a yellow ink, and the liquid jet head 56K for jetting a black ink that are shown in FIG. 1. The same structure includes the identicalness of mass and parameters, such as a size, which define an appearance.

In a case in which the liquid jet heads 56C, 56M, 56Y, and 56K, do not need to be distinguished from each other, the liquid jet heads are denoted by reference numeral 56.

As shown in FIG. 2, the liquid jet head 56 is a line type head. The line type head has a structure in which a plurality of nozzle portions are arranged over a length exceeding the entire width $L_{max}$ of the sheet 36 in a direction orthogonal to the sheet transport direction. The nozzle portions are not shown in FIG. 2.

The liquid jet head 56 shown in FIG. 2 is one aspect of a liquid jet head having a structure in which a plurality of jetting elements are arranged over a length equal to or longer than the entire length of a medium in a direction orthogonal to the medium transport direction.

A direction, which is denoted in FIG. 2 by reference letter X, is a direction orthogonal to the sheet transport direction. A direction, which is denoted in FIG. 2 by reference letter Y, is the sheet transport direction. Hereinafter, the direction orthogonal to the sheet transport direction may be referred to as a sheet width direction or an X direction. Further, the sheet transport direction may be referred to as a Y direction. The sheet transport direction corresponds to the medium transport direction.

The liquid jet head 56 shown in FIG. 2 comprises a plurality of head modules 200. The plurality of head modules 200 are arranged in a line along the sheet width direction. The same structure may be applied to the plurality of head modules 200. Further, the head module 200 may have a structure that can function alone as a liquid jet head.

The liquid jet head 56 in which the plurality of head modules 200 are arranged in a line along the sheet width direction is shown in FIG. 2, but the plurality of head modules 200 may be arranged in two lines so that the phases of the head modules 200 are shifted from each other in the sheet transport direction.

A plurality of nozzle openings are arranged on the liquid jet surfaces 277 of the head modules 200 of the liquid jet head 56. The nozzle openings are not shown in FIG. 2. The nozzle openings are denoted in FIG. 4 by reference numeral 280.

The full-line type liquid jet head 56 is exemplified in this embodiment, but a serial system may be applied. In the serial system, a short serial type liquid jet head shorter than the entire width $L_{max}$ of a sheet 36 is moved in the sheet width direction to perform drawing corresponding to one time in the sheet width direction, the sheet 36 is transported in the sheet transport direction by a certain distance so that drawing in the sheet width direction is performed in the next region in a case in which the drawing corresponding to one time in the sheet width direction is completed, and this operation is repeated so that drawing is performed on the entire surface of the sheet.

<Example of Structure of Head Module>

Next, the head module will be described in detail.

Figure 3:
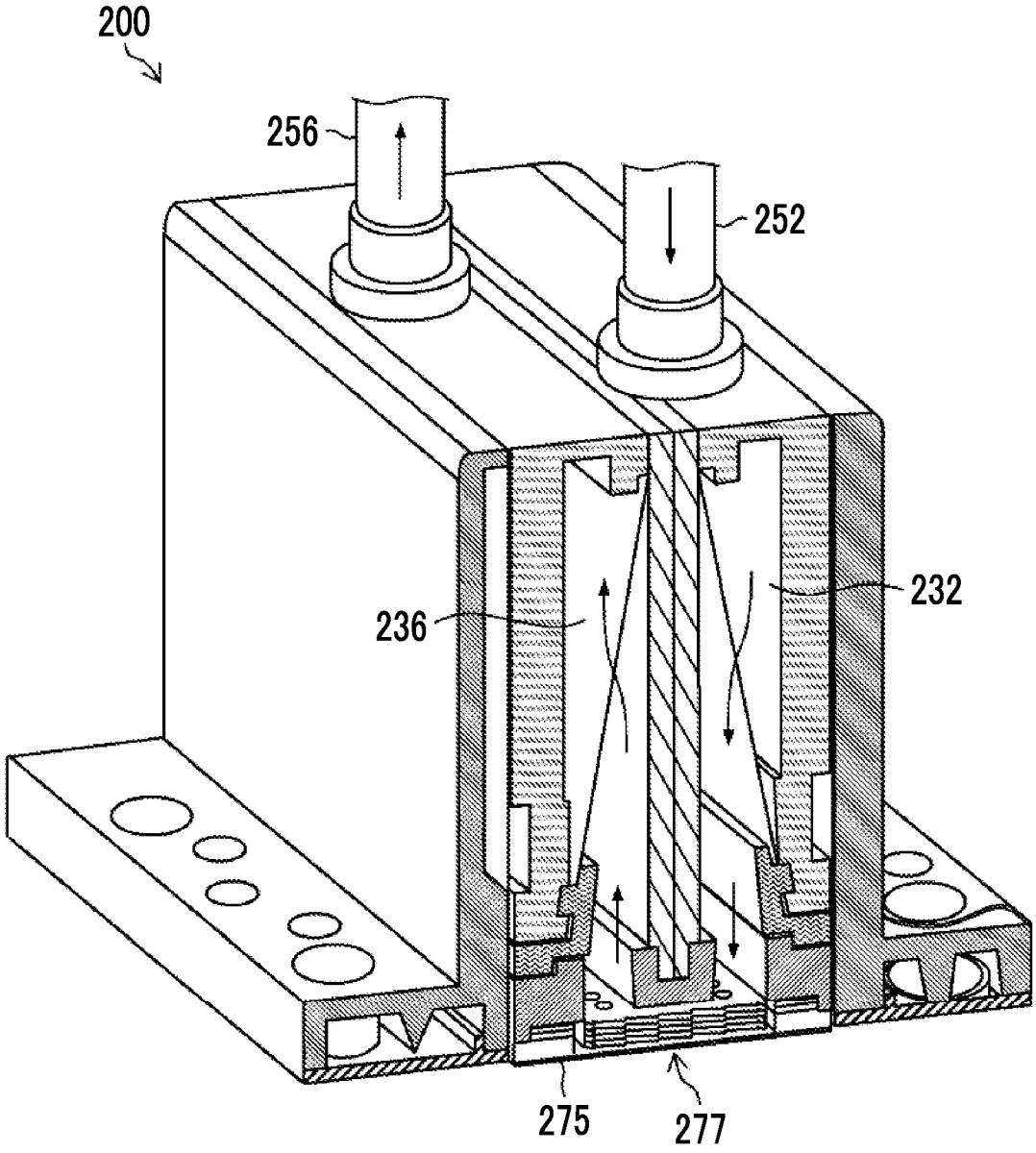
FIG. 3 is a perspective view of a head module including a partial cross-sectional view.
Figure 4:
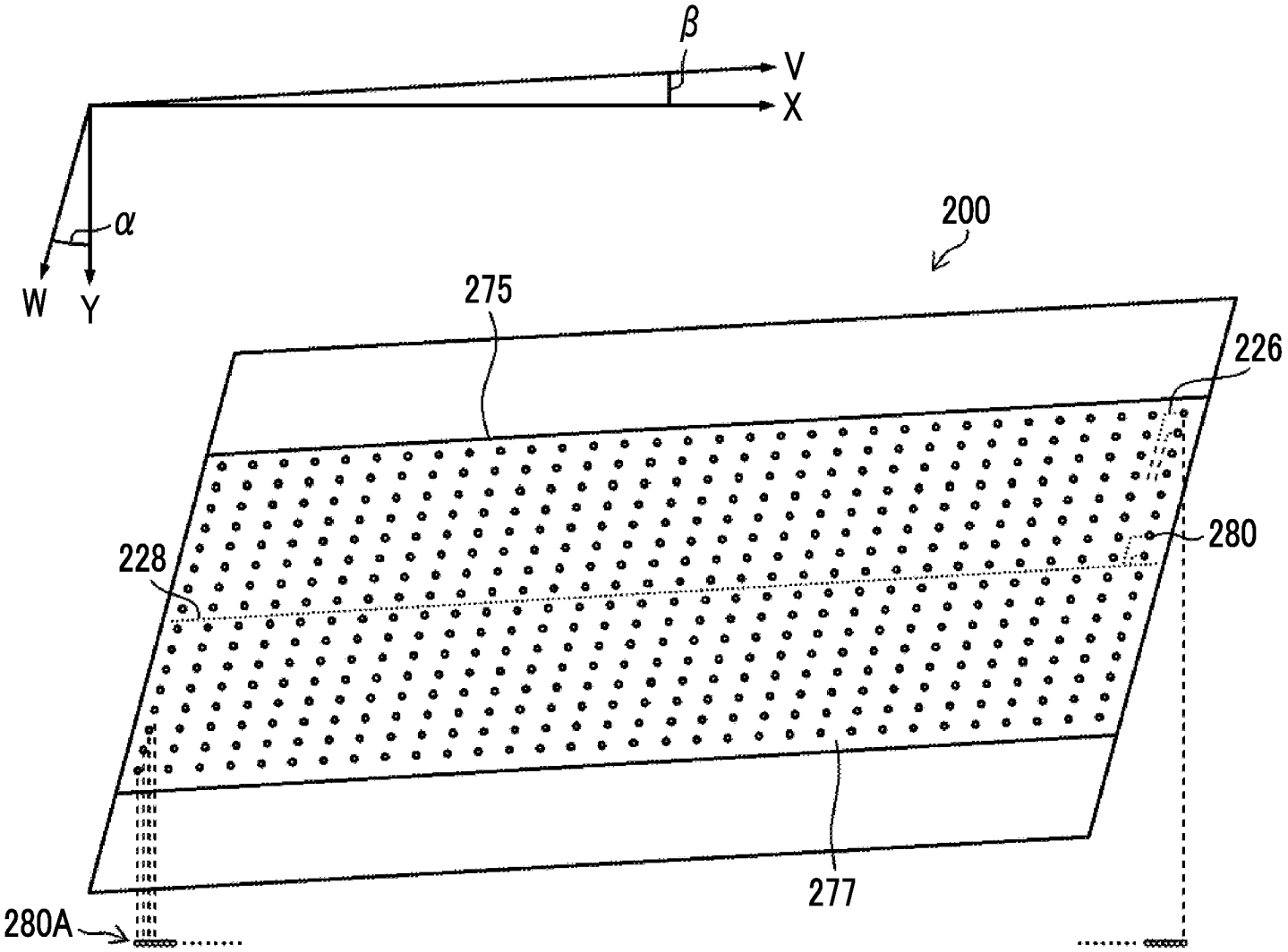
FIG. 4 is a plan perspective view of the liquid jet surface of the head module.

FIG. 3 is a perspective view of the head module including a partial cross-sectional view. FIG. 4 is a plan perspective view of the liquid jet surface of the head module.

As shown in FIG. 3, the head module 200 comprises an ink supply unit. The ink supply unit comprises an ink supply chamber 232 and an ink circulation chamber 236.

The ink supply chamber 232 and the ink circulation chamber 236 are disposed at positions on the side opposite to a liquid jet surface 277 of a nozzle plate 275. The ink supply chamber 232 is connected to an ink tank (not shown) through a supply-side individual flow passage 252. The ink circulation chamber 236 is connected to a collection tank (not shown) through a collection-side individual flow passage 256.

A plurality of nozzle openings 280 are two-dimensionally arranged on the liquid jet surface 277 of the nozzle plate 275 of one head module 200. Only some of the nozzle openings 280 are shown in FIG. 4.

That is, the head module 200 has the planar shape of a parallelogram that has a long-side end face extending in a V direction having an inclination of an angle with respect to the X direction and a short-side end face extending in a W direction having an inclination of an angle $\alpha$ with respect to the Y direction, and the plurality of nozzle openings 280 are arranged in the form of a matrix in a row direction parallel to the V direction and a column direction parallel to the W direction.

The arrangement of the nozzle openings 280 is not limited to the aspect shown in FIG. 4, and the plurality of nozzle openings 280 may be arranged in a row direction parallel to the X direction and a column direction obliquely crossing the X direction.

Here, the matrix arrangement of the nozzle openings 280 is the arrangement of the nozzle openings 280 where the intervals between the nozzle openings 280 are uniform in an X-direction projection nozzle array 280A in which the plurality of nozzle openings 280 are arranged along the X direction in a case in which the plurality of nozzle openings 280 are projected to the X direction.

In the liquid jet head 56 shown in this embodiment, nozzle openings 280 belonging to one head module 200 and nozzle openings 280 belonging to the other head module 200 are mixed at a connecting portion between the adjacent head modules 200 in the X-direction projection nozzle array.

In a case in which there is no error in the mounting position of each head module 200, the nozzle openings 280, which belong to one head module 200, and the nozzle openings 280, which belong to the other head module 200, of a connecting region are arranged at the same positions. Accordingly, the arrangement of the nozzle openings 280 is uniform even in the connecting region.

In the following description, it is assumed that the head modules 200 of the liquid jet head 56 are mounted with no error in the mounting positions thereof.

A broken line denoted in FIG. 4 by reference numeral 228 shows a common circulation flow passage. The common circulation flow passage 228 is a flow passage that is formed in the head module 200. The common circulation flow passage 228 is formed along the V direction. The common circulation flow passage 228 has a length corresponding to the entire length of a region, in which the nozzle portions are formed, in the V direction.

Further, the common circulation flow passage 228 is disposed at the middle position of the region, in which the nozzle portions are formed, in the W direction. The nozzle portions are not shown in FIG. 4. The nozzle portion is denoted in FIG. 5 by reference numeral 281.

A broken line denoted in FIG. 4 by reference numeral 226 shows an individual circulation flow passage. The individual circulation flow passage 226 is a flow passage that is formed in the head module 200. The individual circulation flow passage 226 is formed at a position where the individual circulation flow passage 226 connects each nozzle portion to the common circulation flow passage 228.

<Internal Structure of Head Module>

Figure 5:
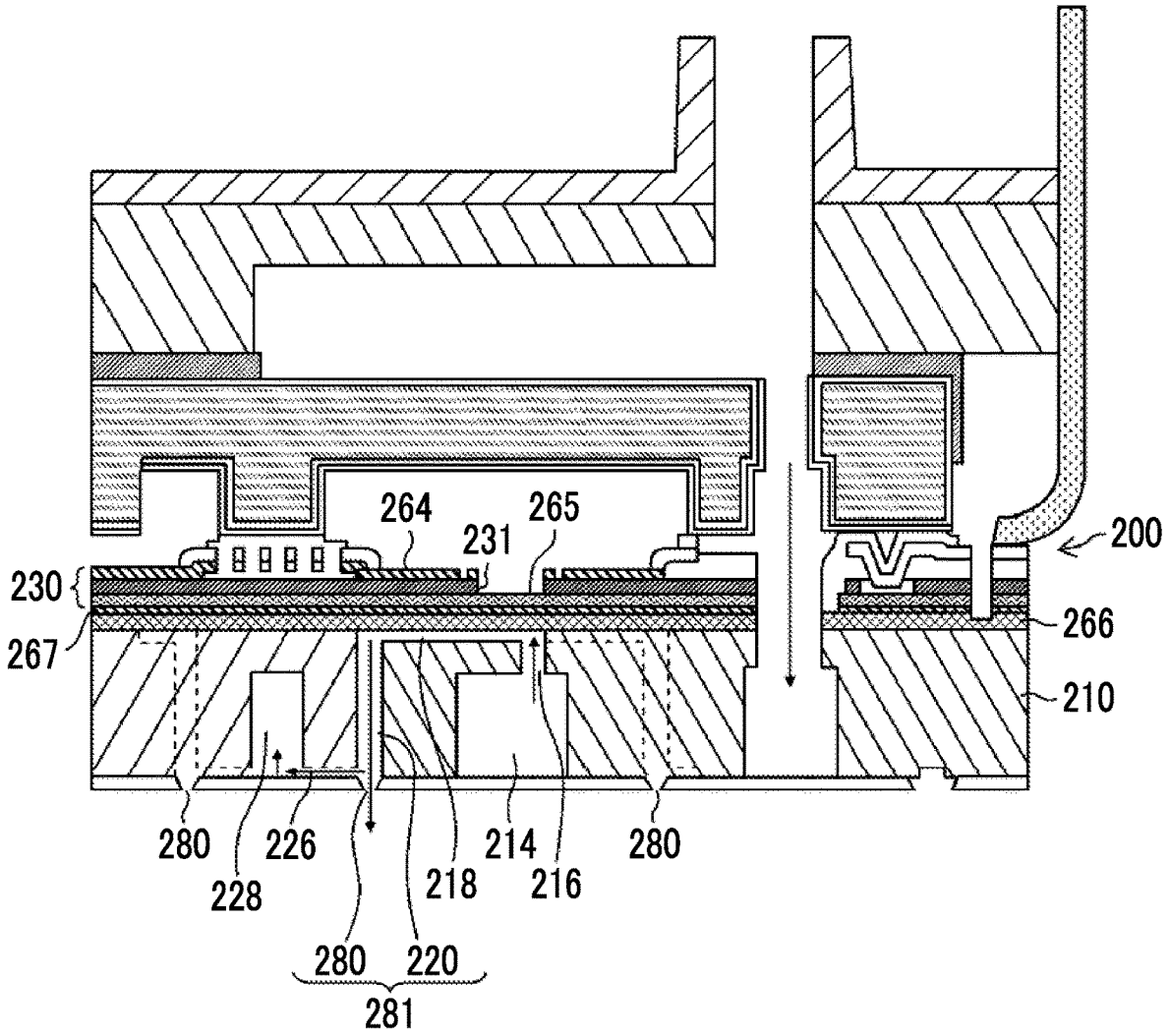
FIG. 5 is a cross-sectional view showing the internal structure of the head module.

FIG. 5 is a cross-sectional view showing the internal structure of the head module. The head module 200 comprises an ink supply passage 214, individual supply passages 216, pressure chambers 218, nozzle communication passages 220, individual circulation flow passages 226, a common circulation flow passage 228, piezoelectric elements 230, and a vibrating plate 266.

The ink supply passage 214, the individual supply passages 216, the pressure chambers 218, the nozzle communication passages 220, the individual circulation flow passages 226, and the common circulation flow passage 228 are formed in a flow passage structure 210. The nozzle portion 281 may comprise the nozzle opening 280 and the nozzle communication passage 220.

The individual supply passage 216 is a flow passage that connects the pressure chamber 218 to the ink supply passage 214. The nozzle communication passage 220 is a flow passage that connects the pressure chamber 218 to the nozzle opening 280. The individual circulation flow passage 226 is a flow passage that connects the nozzle communication passage 220 to the common circulation flow passage 228.

The vibrating plate 266 is provided on the flow passage structure 210. The piezoelectric elements 230 are disposed on the vibrating plate 266 with an adhesive layer 267 therebetween. The piezoelectric element 230 has a stricture in which a lower electrode 265, a piezoelectric layer 231, and an upper electrode 264 are laminated. The lower electrode 265 is called a common electrode, and the upper electrode 264 is called an individual electrode.

The upper electrode 264 is formed of an individual electrode that is patterned so as to correspond to the shape of each pressure chamber 218, and the piezoelectric element 230 is provided for each pressure chamber 218.

The ink supply passage 214 is connected to the ink supply chamber 232 described in FIG. 3. Ink is supplied to the pressure chamber 218 from the ink supply passage 214 through the individual supply passage 216, in a case in which a drive voltage is applied to the upper electrode 264 of the piezoelectric element 230 to be operated according to image data, the piezoelectric element 230 and the vibrating plate 266 are deformed and the volume of the pressure chamber 218 is changed.

The head module 200 can jet ink droplets from the nozzle openings 280 through the nozzle communication passages 220 due to a change in pressure that is caused by a change in the volume of the pressure chamber 218.

In a case in which the drive of the piezoelectric elements 230 corresponding to the respective nozzle openings 280 is controlled according to dot data that is generated from the image data, the head module 200 can jet ink droplets from the nozzle openings 280. In this specification, the jet of ink droplets and the jet of ink can be replaced with each other.

In a case in which jetting timings of ink droplets from the respective nozzle openings 280 shown in FIG. 4 are controlled according to the transport speed of a sheet 36 while the sheet 36 shown in FIG. 2 is transported in the sheet transport direction at a certain speed, a desired image is formed on the sheet 36.

Although not shown, the planar shape of the pressure chamber 218 provided so as to correspond to each nozzle opening 280 is a substantially square shape, an outlet, which is to be connected to the nozzle opening 280, is provided at one corner portion of both corner portions positioned on a diagonal line, and the individual supply passage 216, which is an inlet for ink to be supplied, is provided at the other corner portion thereof.

The shape of the pressure chamber is not limited to a square shape. The planar shape of the pressure chamber may be various shapes, such as a quadrangular shape (a rhombic shape, a rectangular shape, and the like), a pentagonal shape, a hexagonal shape, other polygonal shapes, a circular shape, an elliptical shape, and the like.

A circulation outlet (not shown) is formed at the nozzle portion 281 that includes the nozzle opening 280 and the nozzle communication passages 220. The nozzle portion 281 communicates with the individual circulation flow passage 226 through the circulation outlet. Ink, which is not used for jetting, of ink of the nozzle portion 281 is collected to the common circulation flow passage 228 through the individual circulation flow passage 226.

The common circulation flow passage 228 is connected to the ink circulation chamber 236 described in FIG. 3. Since ink is normally collected to the common circulation flow passage 228 through the individual circulation flow passage 226, the thickening of ink of the nozzle portion 281 during a period in which ink is not jetted is prevented.

The piezoelectric element 230 having a structure individually separated so as to correspond to each nozzle portion 281 is exemplified in FIG. 5 as an example of a piezoelectric element. Of course, a structure in which the piezoelectric layer 231 is integrally formed so as to correspond to the plurality of nozzle portions 281, the individual electrode is formed so as to correspond to each nozzle portion 281, and an active region is formed for each nozzle portion 281 may be applied.

The head module 200 may comprise a heater, which is provided in the pressure chamber 218, as a pressure generating element instead of the piezoelectric element. A thermal system, which supplies a drive voltage to the heater to allow the heater to generate heat and uses a film boiling phenomenon to jet ink present in the pressure chamber 218 from the nozzle opening 280, may be applied to the head module 200. The nozzle portion 281 shown in FIG. 5 is one aspect of a jetting element.

<Description of Head Raising/Lowering Unit>

Figure 7:
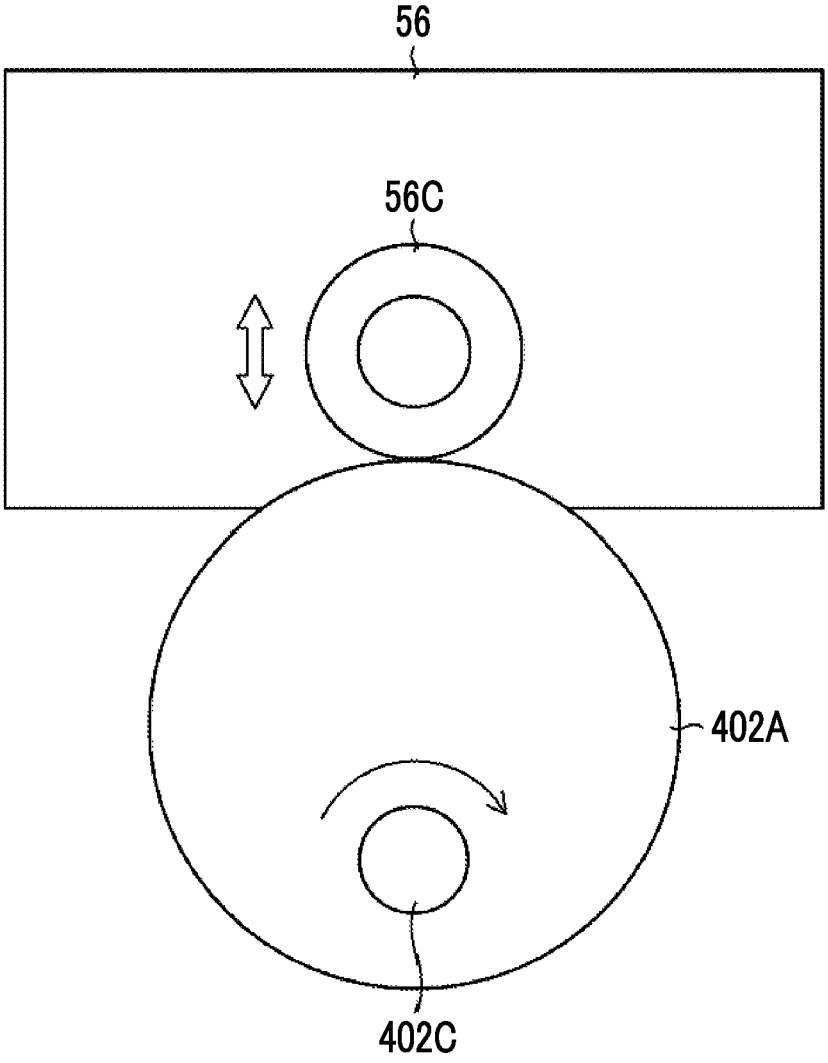
FIG. 7 is a diagram showing the head raising/lowering unit shown in FIG. 6 that is viewed from one end of the liquid jet head in a longitudinal direction.

FIG. 6 is a schematic diagram showing the schematic configuration of the head raising/lowering unit. FIG. 7 is a diagram showing the head raising/lowering unit 400 shown in FIG. 6 that is viewed from one end of the liquid jet head in a longitudinal direction. The head raising/lowering units 400 having the same structure can be applied to the liquid jet heads 56C, 56M, 56Y, and 56K shown in FIG. 1.

Any one of the liquid jet heads 56C, 56M, 56Y, and 56K shown in FIG. 1 is shown in FIGS. 6 and 7. The liquid jet head is denoted in FIGS. 6 and 7 by reference numeral 56.

The longitudinal direction of the liquid jet head 56 is a direction parallel to the sheet width direction in a state where the liquid jet head 56 is mounted on the ink jet recording apparatus 10 shown in FIG. 1.

The head raising/lowering unit 400 shown in FIG. 6 comprises an eccentric cam 402A, an eccentric cam 402B, and a cam shaft 404. The eccentric cam 402A is disposed at a position where the eccentric cam 402A supports a bearing 56B mounted on one end 56A of the liquid jet head 56 in a longitudinal direction. Further, the eccentric cam 4102E is disposed at a position where the eccentric cam 402B supports a bearing 56E mounted on the other end 56D of the liquid jet head 56 in the longitudinal direction.

The eccentric cams 402A and 402B are connected to each other by the cam shaft 404. The cam shaft 404 is connected to a rotating shaft 402C of the eccentric cam 402A and a rotating shall 402D of the eccentric cam 402B.

A rotating shaft 406A of a motor 406 is connected to the rotating shaft 402C of the eccentric cam 402A. The rotating shaft 402C of the eccentric cam 402A and the rotating shall 406A of the motor 406 are connected to each other by a connecting member (not shown). Examples of the connecting member include a coupling, a bearing, a belt, a gear, and the like.

The motor 406 is electrically connected to a motor driver 410. Power is supplied to the motor driver 410 from a power source 412. The motor driver 410 is connected to a controller (not shown) so as to be capable of communicating with the controller.

A command signal is sent to the motor driver 410 from the controller (not shown). The motor driver 410 supplies power to the motor 406 on the basis of the command signal. The motor 406 is driven on the basis of the command signal.

In a case in which the rotating shaft 406A of the motor 406 is rotated, the eccentric cams 402A and 402B are rotated. The liquid jet head 56 is raised or lowered according to the rotation of the eccentric cams 402A and 402B. Arrow lines shown in FIGS. 6 and 7 indicate the raising/lowering direction of the liquid jet head 56. An upward direction represents a raising direction. A downward direction represents a lowering direction.

A first head raising/lowering unit is a raising/lowering unit for a liquid jet head that is a first liquid jet head among the liquid jet heads 56C, 56M, and 56Y shown in FIG. 1. A second head raising/lowering unit is a raising/lowering unit for a liquid jet head that is a second liquid jet head among the liquid jet heads 56M, 56Y, and 56K shown in FIG. 1.

[Description of Head Maintenance Section]

Configuration of Head Maintenance Section>

Figure 8:
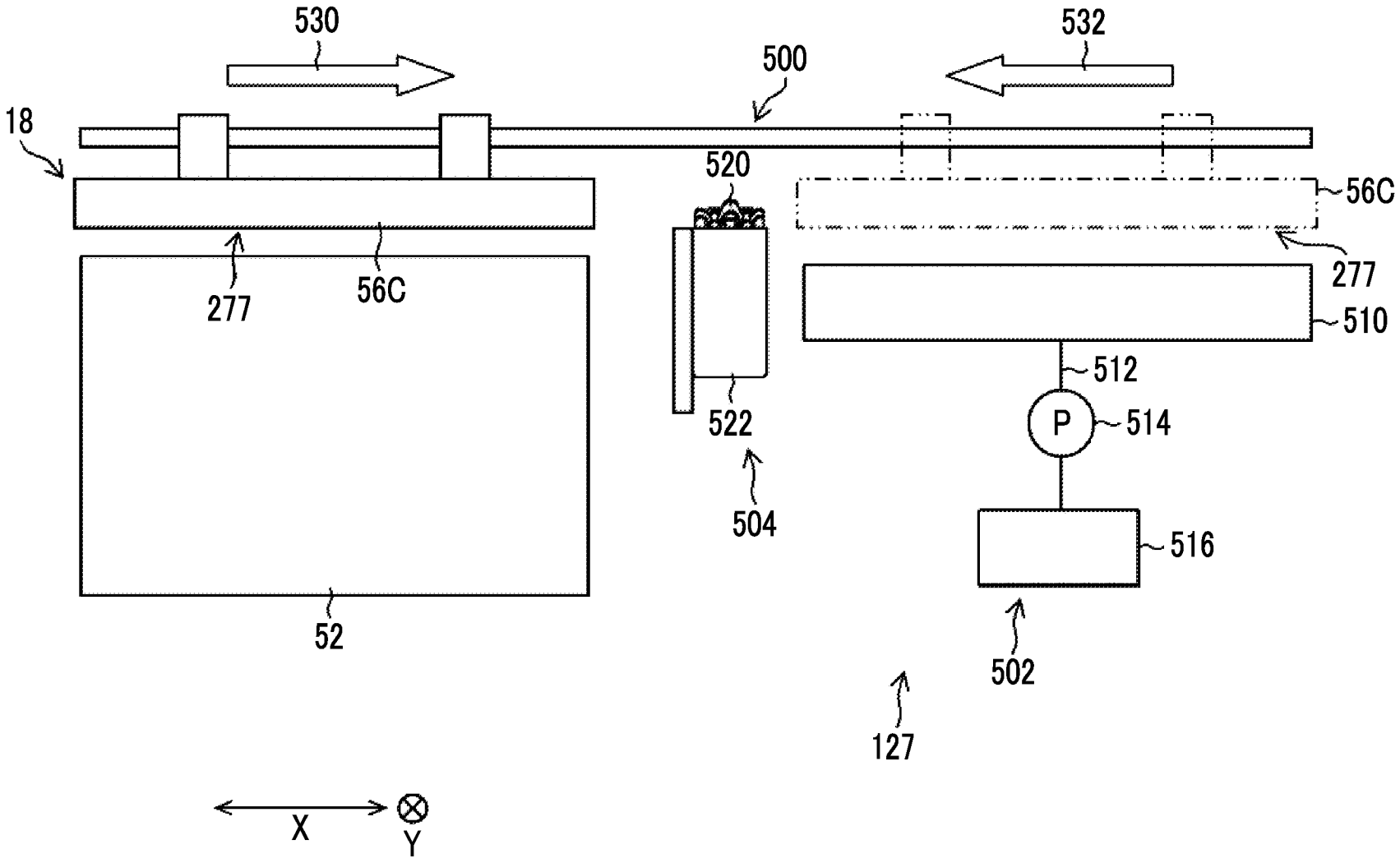
FIG. 8 is a diagram showing the schematic configuration of a head maintenance section.

FIG. 8 is a diagram showing the schematic configuration of the head maintenance section. FIG. 8 is a diagram showing the drawing unit 18 shown in FIG. 1 that is viewed from the upstream side in the sheet transport direction. Only the liquid jet head 56C among the liquid jet heads 56C, 56M, 56Y, and 56K shown in FIG. 1 is shown in FIG. 8.

The head maintenance section 127 shown in FIG. 8 is disposed at a position outside the drawing unit 18 in the sheet width direction. The head maintenance section 127 comprises an ink discharge unit 502 and a wiping unit 504. The ink discharge unit 502 and the wiping unit 504 are arranged in the order of the wiping unit 504 and the ink discharge unit 502 from the drawing unit 18 in the sheet width direction.

The ink discharge unit 502 comprises a cap 510, a discharge flow passage 512, a suction pump 514, and a discharge tank 516. The cap 510 is disposed at a position below an ink discharge position of the liquid jet head 56C.

The ink discharge position of the liquid jet head 56C is the position of the liquid jet head 56C that is shown by a two-dot chain line.

The surface of the cap 510, which is to be in contact with the liquid jet surface 277 of the liquid jet head 56C, has a planar shape corresponding to the shape of the liquid jet surface 277 of the liquid jet head 56C. A recessed portion (not shown) is formed on the surface of the cap 510 that is shown in FIG. 8 and is to be in contact with the liquid jet surface of the liquid jet head 56C. Ink discharge ports are formed on the bottom of the recessed portion.

The discharge flow passage 512 is disposed at a position where the discharge flow passage 512 connects the cap 510 to the discharge tank 516. One end of the discharge flow passage 512 is connected to the ink discharge ports of the cap 510. The other end of the discharge flow passage 512 is connected to the discharge tank 516. The discharge flow passage 512 is provided with the suction pump 514.

The cap 510 is adapted to be capable of being raised/lowered by a cap-raising/lowering mechanism (not shown). The cap 510 can be raised from a position shown in FIG. 8, and can be in contact with the liquid jet surface 277 of the liquid jet head 56C.

In a state where the cap 510 is in contact with the liquid jet surface 277 of the liquid jet head 56C, ink is discharged from the nozzle portions of the liquid jet head 56C to discharge deteriorated ink, foreign matters, air bubbles, and the like from the nozzle openings. The nozzle openings are not shown in FIG. 8. The nozzle opening is denoted in FIG. 4 by reference numeral 280.

Suction using the suction pump 514 may be applied to the discharge of ink from the nozzle opening. Dummy jet, which uses the piezoelectric element 230 for each nozzle portion 281 shown in FIG. 5, may be applied to the discharge of ink from the nozzle opening. The dummy jet is called preliminary jet.

Purge, which allows ink to be discharged from the nozzle openings in a state where the internal pressure of the liquid jet head 56C shown in FIG. 8 is set to pressure equal to or higher than the atmospheric pressure, may be applied to the discharge of ink from the nozzle portion.

The wiping unit 504 comprises a wiping web 520 and a case 522. The wiping unit 504 comprises a traveling mechanism that allows the wiping web 520 to travel. The traveling mechanism is received in the case 522. The traveling mechanism is not shown.

The wiping unit 504 is disposed at a position below a path along which the liquid jet head 56C passes in a case in which the liquid jet head 56C is to be moved to a position above the ink discharge unit 502 from a position above the drawing unit 18 by the horizontal head moving unit 500.

The wiping unit 504 is adapted to be capable of being raised/lowered by a wiping unit-raising/lowering mechanism (not shown). In a case in which the wiping unit 504 is disposed at a position shown in FIG. 8, the liquid jet surface 277 of the liquid jet head 56C can be wiped while the liquid jet head 56C is moved to the position above the ink discharge unit 502 from the position above the drawing unit 18 by the horizontal head moving unit 500.

In a case in which the liquid jet head 56C is to be moved to the position above the drawing unit 18 from the position above the ink discharge unit 502 by the horizontal head moving unit 500, the wiping unit 504 may be lowered from the position shown in FIG. 8.

The ink discharge unit 502 and the wiping unit 504 shown in FIG. 8 are also provided for each of the liquid jet heads 56M, 56Y, and 56K shown in FIG. 1. That is, head maintenance sections having the same configuration can be applied to the liquid jet heads 56C, 56M, 56Y, and 56K.

The ink discharge unit 502 and the wiping unit 504 are individually provided for each of the liquid jet heads 56C, 56M, 56Y, and 56K shown in FIG. 1.

The ink discharge units 502 and the wiping units 504, which are provided for the liquid jet heads 56C, 56M, 56Y, and 56K shown in FIG. 1, may be formed integrally.

An arrow line, which is denoted in FIG. 8 by reference numeral 530, indicates the moving direction of the liquid jet head 56C in a case in which the liquid jet head 56C is to be moved to the ink discharge position from the position above the drawing unit 18. An arrow line, which is denoted by reference numeral 532, indicates the moving direction of the liquid jet head 56C in a case in which the liquid jet head 56C is to be moved to the position above the drawing unit 18 from the ink discharge position.

The ink discharge unit 502 shown in FIG. 8 is one aspect of a first preliminary jet unit and a second preliminary jet unit.

<Operation of Head Maintenance Section>

After the maintenance of the liquid jet head 56C is started, the liquid jet head 56C is moved to the ink discharge position from the position above the drawing unit 18 by the horizontal head moving unit 500.

In a case in which the liquid jet head 56C is moved to the ink discharge position from the position above the drawing unit 18, wiping processing is performed on the liquid jet surface 277 of the liquid jet head 56C by the wiping unit 504.

After the liquid jet head 56C is moved to the ink discharge position, the cap 510 is in contact with the liquid jet surface 277 of the liquid jet head 56C and ink is discharged from the nozzle portions of the liquid jet head 56C.

After the discharge of ink ends, the cap 510 is separated from the liquid jet surface 277 of the liquid jet head 56C. Then, the liquid jet head 56C is moved to the position above the drawing unit 18 from the ink discharge position. The liquid jet head 56C may be maintained in a state where the cap 510 is mounted on the liquid jet surface 277.

Maintenance processing for the liquid jet heads 56M, 56Y, and 56K shown in FIG. 1 is the same as the maintenance processing for the liquid jet head 56C. The description of the maintenance processing will be omitted.

[Description of Control System]

FIG. 9 is a block diagram showing the schematic configuration of a control system. As shown in FIG. 9, the ink jet recording apparatus 10 comprises the system controller 100. Although not shown, the system controller 100 may comprise a CPU, a ROM, and a RAM.

CPU is an abbreviation for Central Processing Unit. ROM is an abbreviation for Read Only Memory. RAM is an abbreviation for Random Access Memory.

The system controller 100 functions as a total control section that generally controls the respective parts of the ink jet recording apparatus 10. Further, the system controller 100 functions as a calculation section that performs various kinds of calculation processing. Furthermore, the system controller 100 functions as a memory controller that controls the reading of data of a memory and the writing of data.

The ink jet recording apparatus 10 shown in FIG. 9 comprises a communication unit 102 and an image memory 104. The communication unit 102 comprises a communication interface (not shown). The communication unit 102 can transmit and receive data to and from a host computer 103 connected to the communication interface.

The image memory 104 functions as a temporary storage section for various kinds of data including image data. Data is read from and written in the image memory 104 through the system controller 100. Image data, which is taken from the host computer 103 through the communication unit 102, is temporarily stored in the image memory 104.

The ink jet recording apparatus 10 shown in FIG. 9 comprises a sheet feed control unit 110, a transport control unit 112, a treatment liquid-application control unit 116, a treatment liquid-drying processing control unit 117, a drawing control unit 118, a head movement control unit 120, an ink-drying processing control unit 122, a sheet discharge control unit 124, and a maintenance control unit 126.

The sheet feed control unit 110 allows the sheet feed unit 12 to be operated according to a command sent from the system controller 100. The sheet feed control unit 110 controls an operation for starting feeding the sheet 36, an operation for stopping feeding, the sheet 36, and the like.

The transport control unit 112 controls the operation of a transport unit 114 for the sheet 36 in the ink jet recording apparatus 10. The transport unit 114 shown in FIG. 9 includes the treatment liquid drum 42, the treatment liquid-drying processing drum 46, the drawing drum 52, and the sheet transport member 22 shown in FIG. 1.

The treatment liquid-application control unit 116 allows the treatment liquid-application section 14 to be operated according to a command sent from the system controller 100. The treatment liquid-application control unit 116 controls the amount of treatment liquid to be applied, a treatment liquid-application timing, and the like.

The treatment liquid-drying processing control unit 117 allows the treatment liquid-drying processing section 16 to be operated according to a command sent from the system controller 100. The treatment liquid-drying processing control unit 117 controls drying temperature, the flow rate of dry gas, the injection timing of dry gas, and the like.

The drawing control unit 118 controls the operation of the drawing unit 18 according to a command sent from the system controller 100. That is, the drawing control unit 118 controls the jet of ink from the liquid jet heads 56C, 56M, 56Y, and 56K shown in FIG. 1.

The drawing control unit 118 includes an image processing section (not shown). The image processing section generates dot data from input image data. The image processing section comprises a color separation processing section, a color conversion processing section, a correction processing section, and a halftoning section (not shown).

In the color separation processing section, color separation processing is performed on the input image data. For example, in a case in which the input image data is represented in RGB, the input image data is separated into data of the respective colors of R, G, and B. Here, R represents red. G represents green. B represents blue.

In the color conversion processing section, image data, which are separated into the data of R, G, and B and correspond to the respective colors, are converted into C, M, Y, and K corresponding to the colors of inks. Here, C represents cyan. M represents magenta. Y represents yellow K represents black.

In the correction processing section, correction processing is performed on the image data that are converted into C, M, Y, and K and correspond to the respective colors. Examples of the correction processing include gamma correction processing, processing for correcting density unevenness, processing for correcting an abnormal recording element, and the like.

In the halftoning section, image data represented by multiple numbers of gradations in the range of, for example, 0 to 255 are converted into dot data represented by a binary value or a multi-level value that is a ternary value or more and is smaller than the number of gradations of the input image data.

In the halftoning section, a predetermined halftoning rule is applied. Examples of the halftoning rule include a dither method, an error diffusion method, and the like. The halftoning rule may be changed according to image recording conditions, the contents of image data, or the like.

The drawing control unit 118 includes a waveform generation unit, a waveform storage unit, and a drive circuit (not shown). The waveform generation unit generates a waveform of a drive voltage. The waveform of the drive voltage is stored in the waveform storage unit. The drive circuit generates a drive voltage having a drive waveform corresponding to dot data. The drive circuit supplies the drive voltage to the liquid jet heads 56C, 56M, 56Y, and 56K shown in FIG. 1.

That is, a jetting timing and the amount of ink to be jetted at the position of each pixel are determined on the basis of dot data generated through the processing that is performed by the image processing section, a drive voltage corresponding to the jetting timing and the amount of ink to be jetted at the position of each pixel and a control signal determining the jetting timing at each pixel are generated, this drive voltage is supplied to the liquid jet heads, and dots are formed by the ink jetted from the liquid jet heads.

The head movement control unit 120 shown in FIG. 9 allows the head raising/lowering unit 400 and the horizontal head moving unit 500 to be operated according to commands sent from the system controller 100. A head moving unit 121 shown in FIG. 9 includes the head raising/lowering units 400 and the horizontal head moving units 500.

The head movement control unit 120 comprises a head raising/lowering control unit that controls the operations of the head raising/lowering units 400 and a horizontal head movement control unit that controls the operation of the horizontal head moving units 500.

The head raising/lowering control unit comprises the motor driver 410 and the power source 412 shown in FIG. 6 and a controller (not shown). The horizontal head movement control unit comprises a driver that is electrically connected to a motor included in the horizontal head moving unit 500, a power source that supplies power to the driver, and a controller that is connected to the driver so as to be capable of communicating with the driver. The driver, the power source, and the controller of the horizontal head movement control unit are not shown.

The head raising/lowering control unit may be divided into a first head raising/lowering control unit that controls the operation of the first head raisin lowering unit and a second head raising/lowering control unit that controls the operation of the second head raising/lowering unit.

The ink-drying processing control unit 122 allows the ink-drying processing section 20 to be operated according to a command sent from the system controller 100. The ink-drying processing control unit 122 controls the temperature of dry gas, the flow rate of dry gas, the injection timing of dry gas, or the like.

The sheet discharge control unit 124 allows the sheet discharge unit 24 to be operated according to a command sent from the system controller 100. The sheet discharge control unit 124 may control the sorting of a sheet 36 that is subjected to normal drawing and a sheet 36 that is determined as a waste sheet.

The maintenance control unit 126 controls the operation of the head maintenance section 127 according to a command sent from the system controller 100. The head maintenance section 127 performs maintenance processing for the liquid jet head 56. Examples of the maintenance processing include purge, dummy jet, and the wiping of the liquid jet surface. The wiping of the liquid jet surface is called wiping. The detail of the head maintenance section 127 will be described later.

The ink jet recording apparatus 10 shown in FIG. 9 comprises an operation unit 130 and a display section 132.

The operation unit 130 comprises an operation member, such as an operation button, a keyboard, or a touch panel. The operation unit 130 may include plural kinds of operation members. The operation member is not shown.

Information, which is input through the operation unit 130, is sent to the system controller 100. The system controller 100 performs various kinds of processing according to the information that is sent from the operation unit 130.

The display section 132 comprises a display device, such as a liquid crystal panel, and a display driver. The display device and the display driver are not shown. The display section 132 allows the display device to display various kinds of information, such as various kinds of configuration information of the apparatus or information on abnormalities of the apparatus, according to a command sent from the system controller 100.

The ink jet recording apparatus 10 shown in FIG. 9 comprises a parameter storage unit 134 and a program storage unit 136.

Various parameters, which are used in the ink jet recording apparatus 10, are stored in the parameter storage unit 134. Various parameters, which are stored in the parameter storage unit 134, are read through the system controller 100 and are set in respective parts of the apparatus.

Various programs, which are used in the respective parts of the ink jet recording apparatus 10, are stored in the program storage unit 136. Various programs, which are stored in the program storage unit 136, are read through the system controller 100 and are executed in respective parts of the apparatus.

The ink jet recording apparatus 10 shown in FIG. 9 comprises a sheet floating detection unit 140. The sheet floating detection unit 140 includes the sheet floating sensor 55 shown in FIG. 1. The sheet floating detection unit 140 determines whether or not the floating of a sheet 36 having passed through a detection region of the sheet floating sensor 55 occurs on the basis of an output signal of the sheet floating sensor 55.

The sheet floating detection unit 140 sends the detection information on a sheet 36, of which the floating occurs, to the system controller 100. In a case in which the system controller 100 acquires the detection information on a sheet 36 of which the floating occurs, the system controller 100 sends commands, which allow the liquid jet heads 56M, 56Y and 56K shown in FIG. 1 to move to the retreat positions, to the head movement control unit 120. The sheet floating detection unit 140 is one aspect of a medium floating detection unit.

The ink jet recording apparatus 10 shown in FIG. 9 comprises a movement parameter setting unit 142. The movement parameter setting unit 142 sets parameters that are applied at the time of retreat operation and return operation of the liquid jet head 56. The parameters, which are set by the movement parameter setting unit 142, are stored in the parameter storage unit 134.

The movement parameter setting unit 142 shown in FIG. 9 may be divided into a first movement parameter setting unit that sets the movement parameters of the first liquid jet head and a second movement parameter setting unit that sets the movement parameters of the second liquid jet head.

[Description of Method of Coping with Floating of Sheet]

First Embodiment

Figure 10:
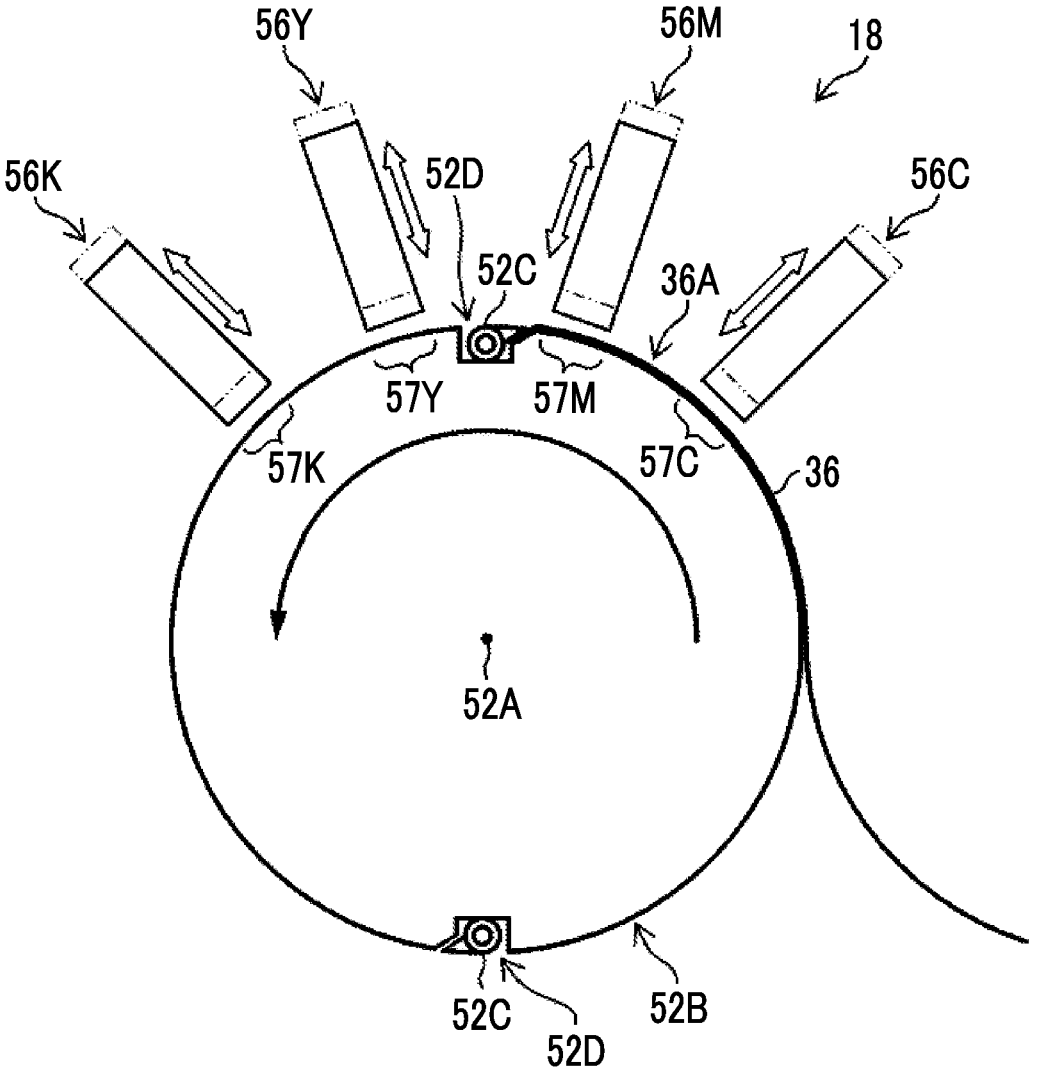
FIG. 10 is a diagram schematically showing a method of coping with the floating of a sheet according to a first embodiment.

FIG. 10 is a diagram schematically showing a method of coping with the floating of a sheet according to a first embodiment. In the following description, the liquid jet heads 56C, 56M, 56Y, and 56K shown in FIG. 10 may be described as the respective liquid jet heads.

The method of coping with the floating of a sheet according to this embodiment includes retreat processing for the respective liquid jet heads. The retreat processing for the respective liquid jet heads is processing for moving the respective liquid jet heads to the retreat positions from the jet positions in the order of the liquid jet heads, which are disposed at positions closer to the upstream side in the sheet transport direction, in a case in which the floating of a sheet 36 is detected.

The method of coping with the floating of a sheet according to this embodiment includes return processing for the respective liquid jet heads. The return processing for the respective liquid jet heads is processing for moving the respective liquid jet heads to the jet positions from the retreat positions. In the return processing for the respective liquid jet heads, the respective liquid jet heads may be moved to the jet positions from the retreat positions in the order of the liquid jet heads that are disposed at positions closer to the upstream side in the sheet transport direction. In the return processing for the respective liquid jet heads, the movement of the respective liquid jet heads may be started at the same time.

Arrow lines shown in FIG. 10 indicate the moving directions of the respective liquid jet heads. The moving direction of each liquid jet head at the time of the retreat processing is an obliquely upward direction. The obliquely upward direction is a direction that has a component in a direction opposite to the direction of gravity.

The moving direction of each liquid jet head at the time of the return processing is an obliquely downward direction. The obliquely downward direction is a direction that has a component parallel to the direction of gravity. The moving direction of each liquid jet head at the time of the return processing is a direction opposite to the moving direction of each liquid jet head at the time of the retreat processing.

The respective liquid jet heads, which are shown in FIG. 10 by a solid line, are the respective liquid jet heads that are disposed at the jet positions. The respective liquid jet heads, which are shown by a two-dot chain line, are the respective liquid jet heads that are disposed at the retreat positions.

The jet position is the position of each liquid jet head on a raising/lowering path, and is the position of each liquid jet head in a case in which ink is jetted from each liquid jet head. A distance between the first surface 36A of the sheet 36 and the liquid jet surface 277 of each liquid jet head at the jet position can be set in the range of 0.5 mm to 1.0 mm.

The retreat position of each liquid jet head is the position of each liquid jet head on the raising/lowering, path, and a distance between the outer peripheral surface 52B of the drawing drum 52, which is the sheet support surface, and the liquid jet surface at the retreat position exceeds the maximum height of the sheet 36, of which the floating is detected, from the outer peripheral surface 52B of the drawing drum 52. A height is a length in the direction opposite to the direction of gravity.

Distances between the outer peripheral surface 52B of the drawing drum 52 and the liquid jet surfaces at the retreat positions of the respective liquid jet heads are equal to each other.

The retreat position is the position of each liquid jet head above the jet position of each liquid jet head. A distance between the first surface 36A of the sheet 36 and the liquid jet surface 277 of each liquid jet head at the retreat position can be set to 2.0 mm or more.

The jet position of the liquid jet head, which is a first liquid jet head among the liquid jet heads 56C, 56M, and 56Y shown in FIG. 10, corresponds to a first jet position. Further, the jet position of the liquid jet head, which is a second liquid jet head among the liquid jet heads 56M and 56Y shown in FIG. 10, corresponds to a second jet position.

The retreat position of the liquid jet head, which is the first liquid jet head among the liquid jet heads 56C, 56M, and 56Y shown in FIG. 10, corresponds to a first retreat position. Further, the retreat position of the liquid jet head, which is the second liquid jet head among the liquid jet heads 56M and 56Y shown in FIG. 10, corresponds to a second retreat position.

Reference numeral 52C of FIG. 10 denotes the grippers. Reference numeral 52D denotes recessed portions in which the grippers 52C are to be disposed. Reference numeral 57C denotes the liquid jet region of the liquid jet head 56C. Reference numeral 57M denotes the liquid jet region of the liquid jet head 56M. Reference numeral 57Y denotes the liquid jet region of the liquid jet head 56Y. Reference numeral 57K denotes the liquid jet region of the liquid jet head 56K.

The liquid jet heads 56C, 56M, and 56Y shown in FIG. 10 are one aspect of the first liquid jet head. For example, in a case in which the first liquid jet head is the liquid jet head 56C, the second liquid jet head is at least one of the liquid jet head 56M, the liquid jet head 56Y, or the liquid jet head 56K.

In a case in which the first liquid jet head is the liquid jet head 56M, the second liquid jet head is any one of the liquid jet head 56Y or the liquid jet head 56K. In a case in which the first liquid jet head is the liquid jet head 56Y, the second liquid jet head is the liquid jet head 56K.

The drawing unit 18 shown in FIG. 10 is one aspect of a medium transport unit. The outer peripheral surface 52B of the drawing unit 18 is one aspect of a medium support surface.

A first liquid jet region is the liquid jet region of the liquid jet head, which is the first liquid jet head, among the liquid jet region 57C of the liquid jet head 56C, the liquid jet region 57M of the liquid jet head 56M, and the liquid jet region 57Y of the liquid jet head 56Y shown in FIG. 10.

A second liquid jet region is the liquid jet region of the liquid jet head, which is the second liquid jet head, among the liquid jet region 57M of the liquid jet head 56M, the liquid jet region 57Y of the liquid jet head 56Y, and the liquid jet region 57K of the liquid jet head 56K shown in FIG. 10.

Figure 11:
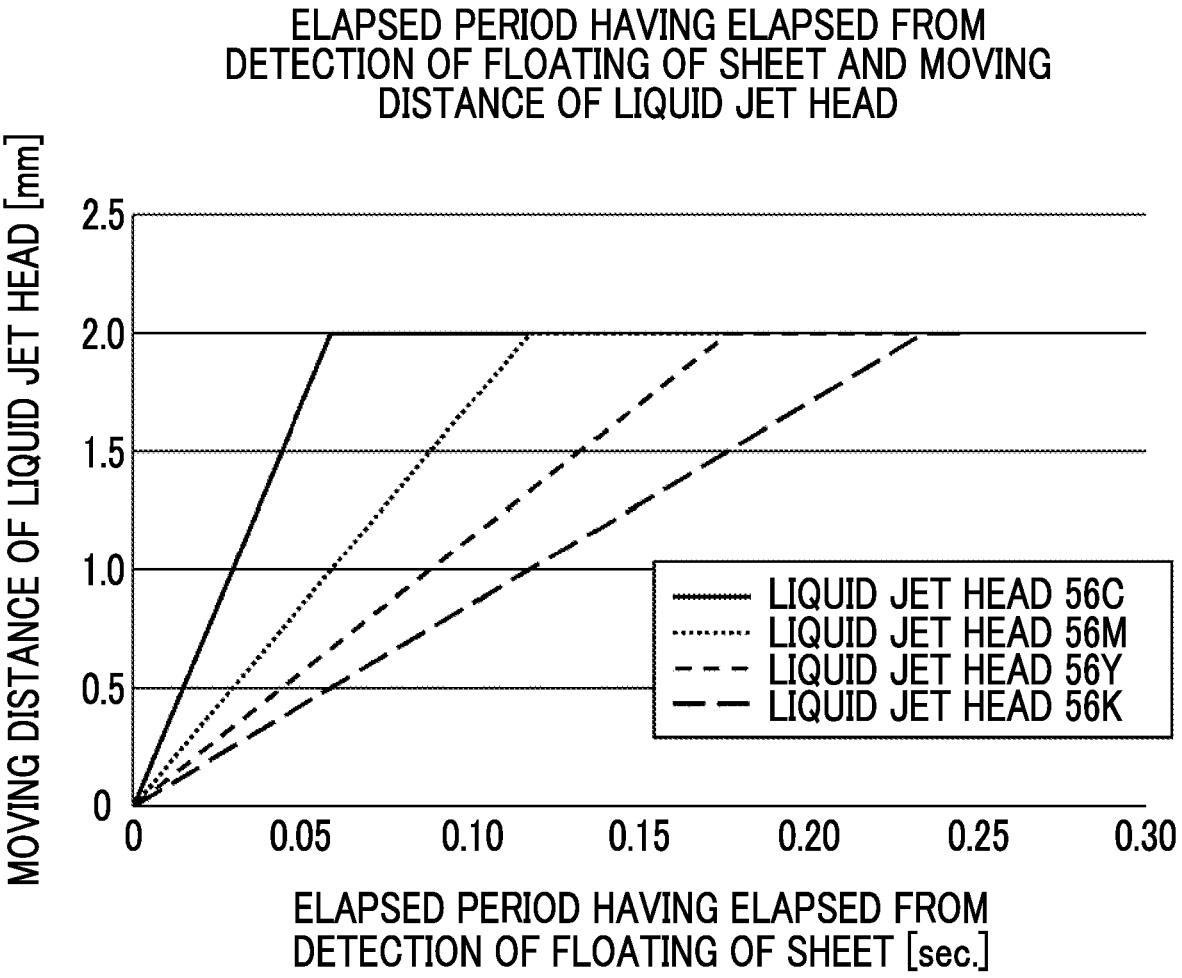
FIG. 11 is a graph showing a relationship between an elapsed period having elapsed from the detection of the floating of a sheet and the moving distance of each liquid jet head in the method of coping with the floating of a sheet according to the first embodiment.

FIG. 11 is a graph showing a relationship between an elapsed period having elapsed from the detection of the floating of a sheet and the moving distance of each liquid jet head in the method of coping with the floating of a sheet according to the first embodiment. A horizontal axis of the graph shown in FIG. 11 represents an elapsed period having elapsed from the detection of the floating of a sheet. The unit of the horizontal axis is second. A vertical axis of the graph shown in FIG. 11 represents the moving distances of the respective liquid jet heads. The unit of the vertical axis is millimeter.

The moving distance of each liquid jet head shown in FIG. 11 is a distance between each liquid jet head and the jet position in the moving direction of each liquid jet head in a case in which each liquid jet head is moved to the retreat position from the jet position.

The maximum value of the moving distance of each liquid jet head shown in FIG. 11 is a distance between the jet position and the retreat position. The numerical values of the horizontal axis and the vertical axis shown in FIG. 11 correspond to Table 1 to be described later. The same applies to FIG. 12.

A timing when the sheet 36 reaches the position of the liquid jet region of each liquid jet head is later in the case of the liquid jet head that is disposed at a position closer to the downstream side in the sheet transport direction. Here, the position of the liquid jet region corresponds to the upstream end of the liquid jet region in the sheet transport direction.

In a case in which the retreat processing for each liquid jet head is started at the same time as the detection of the floating of the sheet 36, the magnitude of the speed of each liquid jet head 56 may be relatively smaller in the case of the liquid jet head that is disposed at a position closer to the downstream side in the sheet transport direction.

The same time means the same time in controlling. Since delay caused by an electrical circuit or delay caused by mechanical variation occurs in a case in which control is performed at the same time, there may be a case where the operations of the respective liquid jet heads are not actually started at the same time.

In a case in which a distance between the position of the sheet floating sensor 55 and the position of the liquid jet region of each liquid jet head is L mm and the magnitude of transport speed v of the sheet 36 is |v| mm/s, a period $t_{SH}$ in which the sheet 36 is moved to the position of the liquid jet region of each liquid jet head from the position of the sheet floating sensor 55 is represented by Equation 1 to be described below.

$$t_{SH}=L/|v| \qquad \text{Equation 1}$$

The unit of the period $t_{SH}$ shown in Equation 1 is second. Since the value of the distance L is relatively larger in the case of the liquid jet head that is disposed at a position closer to the downstream side in the sheet transport direction, the value of the period $t_{SH}$ is relatively larger in the case of the liquid jet head that is disposed at a position closer to the downstream side in the sheet transport direction.

In a case in which a distance between the retreat position and the jet position of each liquid jet head is H mm, the magnitude $|u_1|$ of the speed $u_1$ of each liquid jet head at the time of the retreat processing is represented by Equation 2 to be described below.

$$|u_1|=H/t_{SH} \qquad \text{Equation 2}$$

The unit of the speed $u_1$ is mm/s. Each liquid jet head performs a constant-speed operation of which the magnitude of an initial speed of each liquid jet head is set to $|u_1|$. The magnitude $|u_1|$ of the speed of each liquid jet head means the inclination of each straight line shown in FIG. 11. In regard to the speed $u_1$ of each liquid jet head, a direction toward the retreat position from the jet position is a normal direction. Since the value of the period $t_{SH}$ is relatively larger in the case of the liquid jet head that is disposed at a position closer to the downstream side in the sheet transport direction, the value of the magnitude $|u_1|$ of the speed $u_1$ is relatively smaller in the case of the liquid jet head that is disposed at a position closer to the downstream side in the sheet transport direction.

As shown in FIG. 11, the movement of the liquid jet heads 56C, 56M, 56Y, and 56K is started at the same time. A timing when an elapsed period is zero in regard to an elapsed period having elapsed from the detection of the floating of a sheet shown in FIG. 11 corresponds to a first timing when the operation of the first head raising/lowering, unit is to be started.

The movement of the liquid jet heads 56M, 56Y, and 56K may be started during a period in which the liquid jet head 56C is moved.

Then, the operations of the liquid jet heads 56C, 56M, 56Y, and 56K are stopped in an order in which the liquid jet heads 56C, 56M, 56Y, and 56K reach the retreat positions. The operation of the liquid jet head, which is disposed at a position on the upstream side in the sheet transport direction, is stopped during the operation of the liquid jet head that is disposed at a position on the downstream side in the sheet transport direction.

Figure 12:
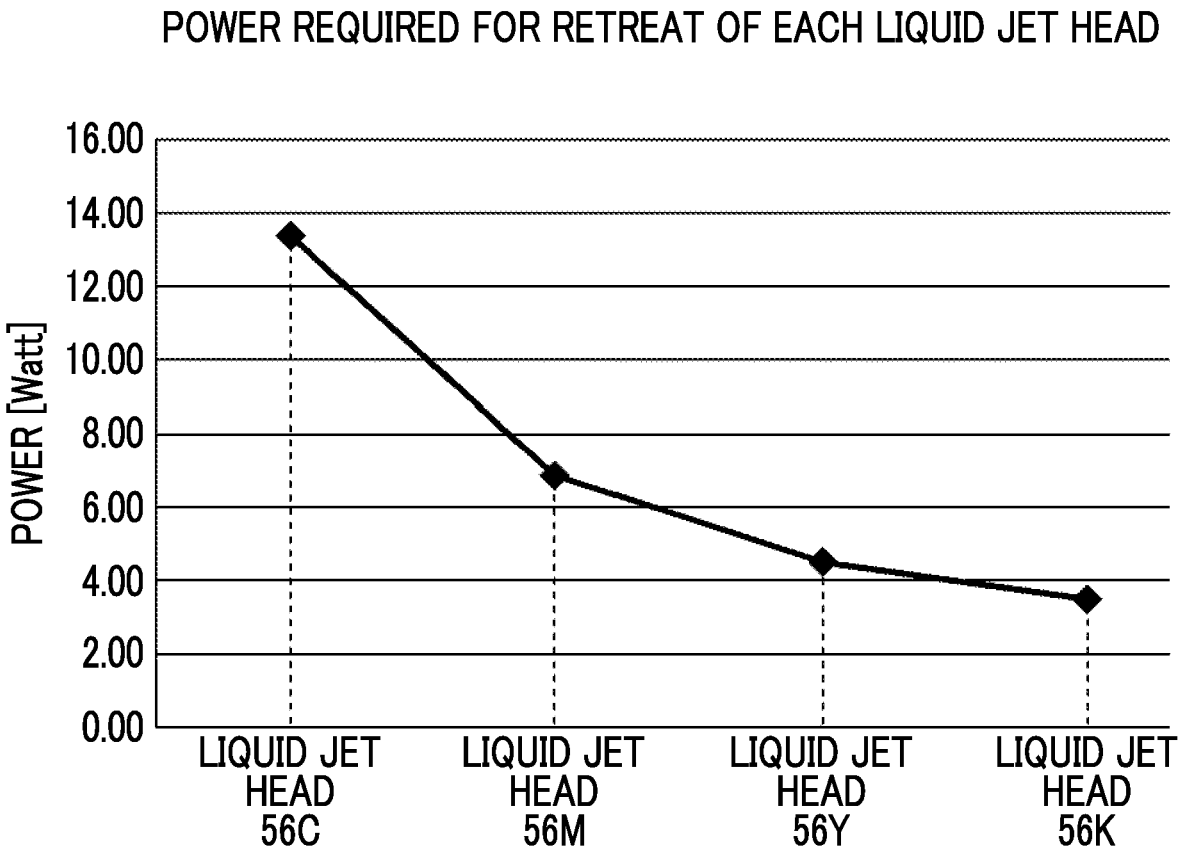
FIG. 12 is a graph showing power required for the retreat of each liquid jet head in the method of coping with the floating of a sheet according to the first embodiment.

FIG. 12 is a graph showing power required for the retreat of each liquid jet head in the method of coping with the floating of a sheet according to the first embodiment. A horizontal axis of the graph shown in FIG. 12 represents the respective liquid jet heads. A vertical axis of the graph shown in FIG. 12 represents the power of each liquid jet head. The unit of the vertical axis is watt.

As shown in FIG. 12, power required to move each liquid jet head to the retreat position from the jet position is relatively smaller in the case of the liquid jet head that is disposed at a position closer to the downstream side in the sheet transport direction.

In a case in which the mass of each liquid jet head is in kg and g is gravitational acceleration, power WA required at the time of the retreat processing is represented by Equation 3 to be described below.

$$WA = m \times g \times |u_1| \qquad \text{Equation 3}$$

The unit of the power WA is watt. The numerical values of the respective axes of the graphs shown in FIGS. 11 and 12 correspond to Table 1 to be described later.

Table 1 shows specific examples of the magnitudes of the speeds of the respective liquid jet heads 56C, 56M, 56Y, and 56K shown in FIG. 10 and specific examples of power required at the time of the retreat processing.

TABLE 1

| | LIQUID JET HEAD | | | |
|---|---|---|---|---|
| | 56C | 56M | 56Y | 56K |
| L [mm] | 62 | 124 | 186 | 248 |
| $t_{SH}$ [sec] | 0.058 | 0.117 | 0.175 | 0.234 |
| $\|u_1\|$ [mm/sec] | 34.19 | 17.10 | 11.40 | 8.55 |
| WA [watt] | 13.42 | 6.71 | 4.47 | 3.35 |

The distance L shown in Table 1 is a distance between the position of the sheet floating sensor 55 and the position of the liquid jet region of each liquid jet head along the outer peripheral surface 52B of the drawing drum 52 shown in FIG. 10.

In the calculation of the period $t_{SH}$ shown in Table 1, the magnitude of the rotational speed of the drawing drum 52 shown in FIG. 10 is set to 2700 rev/h and the diameter of the drawing drum 52 is set to 450 mm. In the calculation of the magnitude $|u_1|$ of the speed $u_1$, a distance H between the jet position and the retreat position of each liquid jet head is set to 2.0 mm. In the calculation of the power WA, gravitational acceleration is set to 9.8 m/s$^2$.

Figure 13:
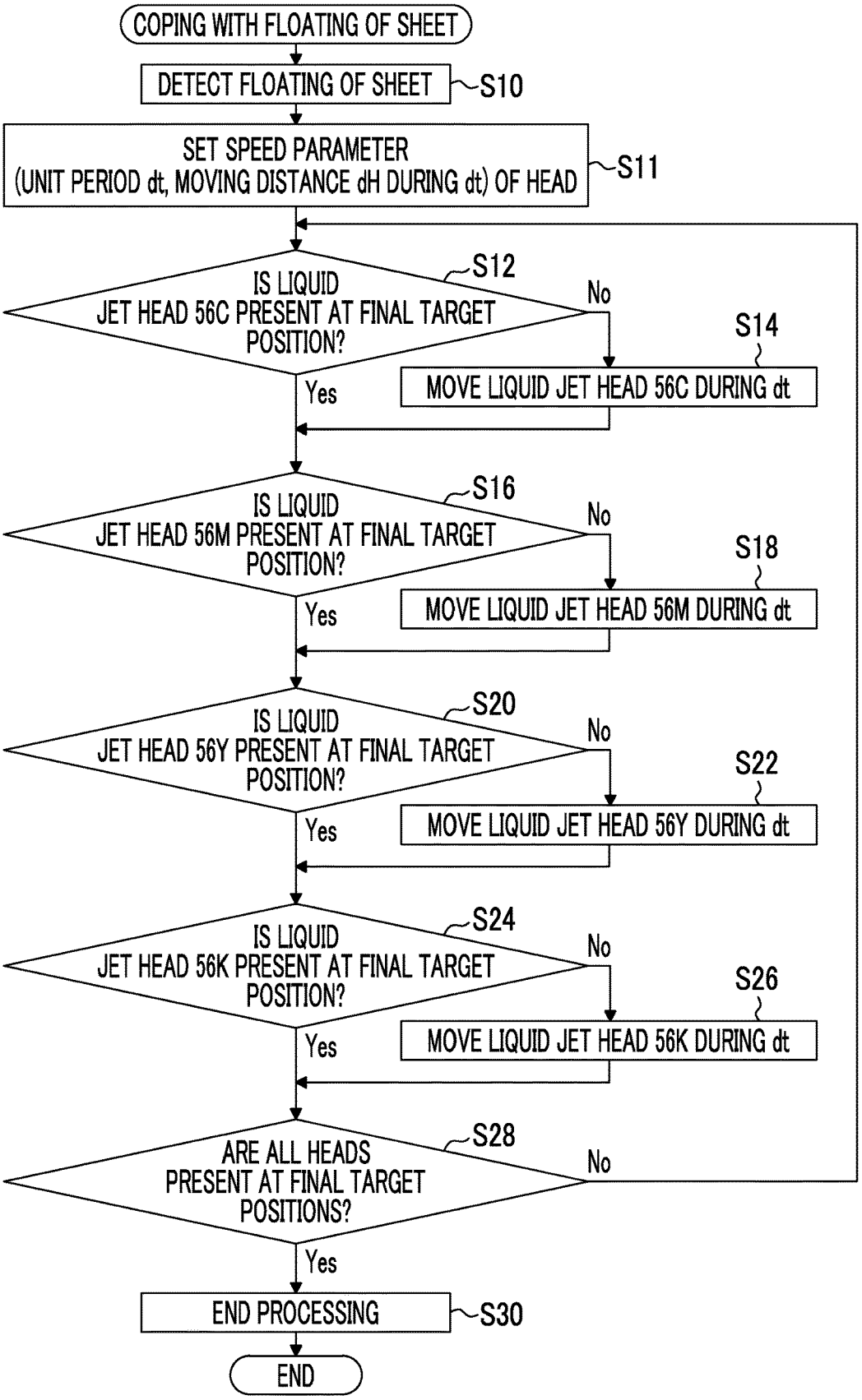
FIG. 13 is a flowchart showing a procedure of the method of coping with the floating of a sheet according to the first embodiment.

Procedure of Method of Coping with Floating of Sheet According to First Embodiment FIG. 13 is a flowchart showing a procedure of the method of coping with the floating of a sheet according to the first embodiment. In a case in which the floating of a sheet is detected in a sheet floating detection step S10, the system controller 100 shown in FIG. 9 starts the method of coping with the floating of a sheet.

That is, the system controller 100 activates a sheet floating coping program in which the procedure of the method of coping with the floating of a sheet is described, and allows the respective parts of the ink jet recording apparatus 10 to be operated according to the procedure described in the sheet floating coping program.

A speed parameter-setting step S11 of FIG. 13 is performed in the method of coping with the floating of a sheet. In the speed parameter-setting step S11 of FIG. 13, the speed parameters of each liquid jet head shown in FIG. 10 are set by the movement parameter setting unit 142 shown in FIG. 9. In this embodiment, a unit period dt and a moving distance of each liquid jet head during the unit period dt are set as the speed parameters.

The speed parameter-setting step S11 of FIG. 13 is one aspect of a second movement parameter-setting step of setting a second movement parameter representing the magnitude of the speed of the second liquid jet head in a direction having an upward component opposite to the direction of gravity that is smaller than the magnitude of the speed of the first jet head.

After the unit period dt and the moving distance dH are set in the speed parameter-setting step S11 of FIG. 13, processing proceeds to a first head position-determination step S12. It is determined in the first head position-determination step S12 whether or not the liquid jet head 56C shown in FIG. 10 reaches the retreat position.

If the liquid jet head 56C shown in FIG. 10 does not reach the retreat position, the determination of No is made in the first head position-determination step S12 of FIG. 13. In a case in which the determination of No is made, processing proceeds to a first head moving step S14 of FIG. 13.

In the first head moving step S14, the liquid jet head 56C shown in FIG. 10 is moved by the moving distance dH during the unit period dt. In a case in which the liquid jet head 56C shown in FIG. 10 is moved by the moving distance in the first head moving step S14 of FIG. 13, processing proceeds to a second head position-determination step S16 of FIG. 13.

On the other hand, if the liquid jet head 56C shown in FIG. 10 reaches the retreat position, the determination of Yes is made in the first head position-determination step S12 of FIG. 13. In a case in which the determination of Yes is made, processing proceeds to the second head position-determination step S16 of FIG. 13.

It is determined in the second head position-determination step S16 whether or not the liquid jet head 56M shown in FIG. 10 reaches the retreat position. If the liquid jet head 56M shown in FIG. 10 does not reach the retreat position, the determination of No is made in the second head position-determination step S16 of FIG. 13. In a case in which the determination of No is made, processing proceeds to a second head moving step S18 of FIG. 13.

In the second head moving step S18, the liquid jet head 56M shown in FIG. 10 is moved by the moving distance dH during the unit period dt. In a case in which the liquid jet head 56M shown in FIG. 10 is moved by the moving distance dH in the second head moving step S18 of FIG. 13, processing proceeds to a third head position-determination step S20 of FIG. 13.

On the other hand, if the liquid jet head 56M shown in FIG. 10 reaches the retreat position, the determination of Yes is made in the second head position-determination step S16 of FIG. 13. In a case in which the determination of Yes is made, processing proceeds to the third head position-determination step S20 of FIG. 13.

It is determined in the third head position-determination step S20 whether or not the liquid jet head 56Y shown in FIG. 10 reaches the retreat position. If the liquid jet head 56Y shown in FIG. 10 does not reach the retreat position, the determination of No is made in the third head position-determination step S20 of FIG. 13. In a case in which the determination of No is made, processing proceeds to a third head moving step S22 of FIG. 13.

In the third head moving step S22, the liquid jet head 56Y shown in FIG. 10 is moved by the moving distance dH during the unit period dt. In a case in which the liquid jet head 56Y shown in FIG. 10 is moved by the moving distance dH in the third head moving step S22 of FIG. 13, processing proceeds to a fourth head position-determination step S24 of FIG. 13.

On the other hand, if the liquid jet head 56Y shown in FIG. 10 reaches the retreat position, the determination of Yes is made in the third head position-determination step S20. In a case in which the determination of Yes is made, processing proceeds to the fourth head position-determination step S24 of FIG. 13.

It is determined in the fourth head position-determination step S24 whether or not the liquid jet head 56K shown in FIG. 10 reaches the retreat position. If the liquid jet head 56K shown in FIG. 10 does not reach the retreat position, the determination of No is made in the fourth head position-determination step S24 of FIG. 13. In a case in which the determination of No is made, processing proceeds to a fourth head moving step S26 of FIG. 13.

In the fourth head moving step S26, the liquid jet head 56K shown in FIG. 10 is moved by the moving distance dH during the unit period dt. In a case in which the liquid jet head 56K shown in FIG. 10 is moved by the moving distance dH in the fourth head moving step S26 of FIG. 13, processing proceeds to an all head position-determination step S28 of FIG. 13.

On the other hand, if the liquid jet head 56K shown in FIG. 10 reaches the retreat position, the determination of Yes is made in the fourth head position-determination step S24 of FIG. 13. In a case in which the determination of Yes is made, processing proceeds to the all head position-determination step S28 of FIG. 13.

It is determined in the all head position-determination step S28 whether or not the liquid jet heads 56C, 56M, 56Y, and 56K shown in FIG. 10 reach the retreat positions.

If the liquid jet heads 56C, 56M, 56Y, and 56K shown in FIG. 10 do not reach the retreat positions, the determination of No is made in the all head position-determination step S28 of FIG. 13. In a case in which the determination of No is made, processing proceeds to the first head position-determination step S12 of FIG. 13. Then, until the determination of Yes is made in the all head position-determination step S28, the first head position-determination step S12 to the second head moving step S18 are repeatedly performed.

On the other hand, if the liquid jet heads 56C, 56M, 56Y and 56K shown in FIG. 10 reach the retreat positions, the determination of Yes is made in the all head position-determination step S28. In a case in which the determination of Yes is made, processing proceeds to an end processing step S30 of 13 and end processing is performed. After the end processing is performed in the end processing step S30, the method of coping with the floating of a sheet ends.

In the method of coping with the floating of a sheet of which the procedure is shown in FIG. 13, the movement of the liquid jet head 56C shown in FIG. 10 is started. The movement of one liquid jet head 56M, which is disposed on the downstream side of the liquid jet head 56C, is started before the liquid jet head 56C reaches the retreat position.

Further, the movement of one liquid jet head 56Y, which is disposed on the downstream side of the liquid jet head 56M, is started before the liquid jet head 56M reaches the retreat position. Furthermore, the movement of one liquid jet head 56K, which is disposed on the downstream side of the liquid jet head 56Y is started before the liquid jet head 56Y reaches the retreat position. The movement of the liquid jet heads 56M, 56Y, and 56K may be started before the liquid jet head 56C reaches the retreat position.

The liquid jet heads 56C, 56M, 56Y, and 56K can reach the retreat positions before the sheet 36 of which the floating is detected reaches the respective liquid jet regions.

Next, the unit period dt and the moving distance dH during the unit period dt, which are set in the speed parameter-setting step S11, will be described in detail. The unit periods dt having the same value are set for the respective liquid jet heads. Time-sharing control is applied for each unit period dt as the control of the movement of each liquid jet head shown in FIG. 10.

That is, each liquid jet head is moved by the moving distance dH, which is a distance sufficiently shorter than a distance between the retreat position and the jet position of each liquid jet head, during the unit period dt that is a period predetermined for each liquid jet head and sufficiently shorter than a period in which each liquid jet head is moved to the retreat position from the jet position.

One liquid jet head is moved by the moving distance dH during the unit period dt, and the next liquid jet head is then moved by the moving distance dH during the unit period dt after the elapse of the unit period dt. Further, the next liquid jet head is moved by the moving distance after the elapse of the unit period dt. All the liquid jet heads are repeatedly moved in sequence by the moving distance dH during the unit period dt, and are moved to the retreat positions from the jet positions.

An intermittent operation for operating each liquid jet head during the non-operation periods of the other liquid jet heads is applied to the movement of each liquid jet head shown in FIG. 13.

Since time-sharing control is applied, the operations of a plurality of liquid jet heads can be controlled by one control unit. In this embodiment, the operations of four liquid jet heads are controlled by one control unit.

In terms of improving control responsiveness, it is preferable that the value of the unit period dt is as small as possible. It is preferable that the unit period dt is 1/100 or less of a period in which the liquid jet head 56C positioned on the most upstream side in the sheet transport direction is moved to the retreat position from the jet position.

The moving distances dH of the respective liquid jet heads during the unit period dt are set to values different for the respective liquid jet heads according to the magnitudes of the speeds in a case in which each liquid jet head is moved to the retreat position from the jet position. The moving distance dH during the unit period dt is derived using a period between a timing when the floating of the sheet 36 of which the floating is detected is detected and a timing when each liquid jet head reaches the jet position and a distance between the jet position and the retreat position of each liquid jet head.

The magnitude $|u_1|$ of the speed $u_1$ of each liquid jet head, which is obtained in a case in which each liquid jet head is moved to the retreat position from the jet position, is dH/dt. The moving distance of the second liquid jet head during the unit period is shorter than the moving distance of the first liquid jet head during the unit period dH/dt may be set as the average value of the magnitude of the speed of each liquid jet head during a period in which each liquid jet head is moved.

On the other hand, in a case in which control units of which the number is equal to the number of the liquid jet heads are used, a plurality of liquid jet heads can be operated during the same period. That is, the head movement control unit 120 shown in FIG. 9 may allow the liquid jet heads 56C, 56M, 56Y and 56K shown in FIG. 10 to be operated in a time-sharing manner, or may allow the liquid jet heads 56C, 56M, 56Y, and 56K shown in FIG. 10 to be operated in parallel during the same period.

The speed parameter-setting step S11 shown in FIG. 13 may be divided into a first movement parameter-setting step of setting the movement parameters of the first liquid jet head and a second movement parameter-setting step of setting the movement parameters of the second liquid jet head.

Effects of First Embodiment

In a case in which the floating of a sheet occurs and each liquid jet head is allowed to retreat to the retreat position from the jet position, the speed parameters are individually set for the liquid jet heads as the movement parameters. The speed of the liquid jet head, which is disposed at a position on the downstream side in the sheet transport direction, is less than the magnitude of the speed of the liquid jet head that is disposed at a position on the upstream side in the sheet transport direction. Accordingly, power required to allow a liquid jet head to retreat to the retreat position from the jet position can be further reduced in the case of the liquid jet head that is disposed at a position closer to the downstream side in the sheet transport direction.

Since the power is reduced, the head raising/lowering unit 400 shown in FIG. 6 can be reduced in size. Examples of a reduction in the size of the head raising/lowering unit 400 include a reduction in the size of a motor and a reduction in the size of a control board.

Further, since the magnitude of speed is reduced, the consumption current of a motor of which the magnitude of speed is reduced can be reduced during the period in which the plurality of liquid jet heads are moved. That is, power consumption can be reduced during the period in which the plurality of liquid jet heads are allowed to be operated.

Second Embodiment

Next, a method of coping with the floating of a sheet according to a second embodiment will be described. In the method of coping with the floating of a sheet according to the second embodiment, an acceleration/deceleration operation is applied instead of the constant-speed operation of the liquid jet head described in the first embodiment.

An acceleration/deceleration operation where the magnitude of acceleration is constant, an acceleration period and a deceleration period are equal to each other, the deceleration period is started immediately after the end of the acceleration period, and a constant-speed period is not provided is applied to the method of coping with the floating of a sheet according to the second embodiment to be described below.

Figure 14:
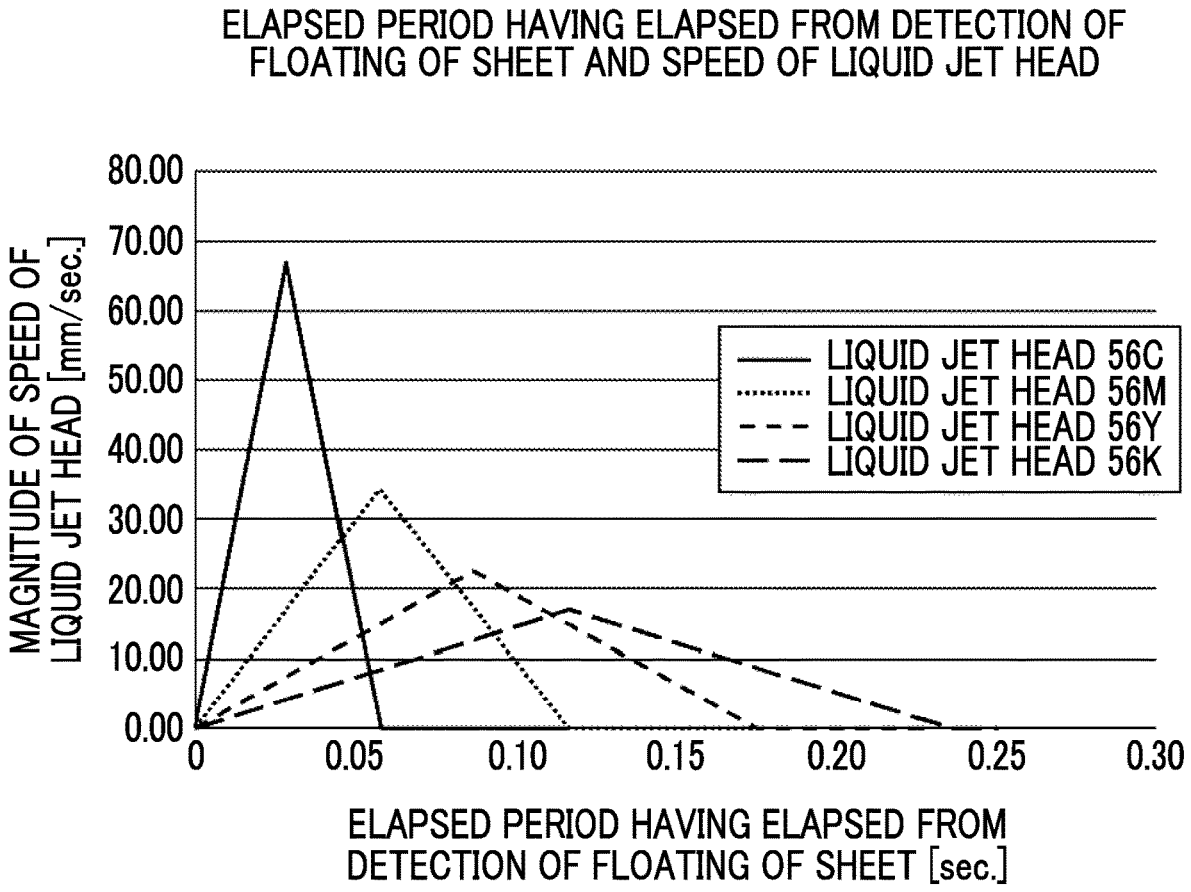
FIG. 14 is a graph showing a relationship between an elapsed period having elapsed from the detection of the floating of a sheet and the magnitude of the speed of each liquid jet head in the method of coping with the floating of a sheet according to a second embodiment.

FIG. 14 is a graph showing a relationship between an elapsed period having elapsed from the detection of the floating of a sheet and the magnitude of the speed of each liquid jet head in the method of coping with the floating of a sheet according to the second embodiment. A horizontal axis of the graph shown in FIG. 14 represents an elapsed period having elapsed from the detection of the floating of a sheet. The unit of the horizontal axis is second. A vertical axis of the graph shown in FIG. 14 represents the magnitude of the speed of each liquid jet head. The unit of the vertical axis is mm/s.

In a case in which the retreat processing for each liquid jet head is started at the same time as the detection of the floating of a sheet 36, as shown in FIG. 14, the magnitude of the speed of each liquid jet head 56 can be made relatively smaller in the case of the liquid jet head that is disposed at a position closer to the downstream side in the sheet transport direction.

In a case in which the magnitude of the acceleration a of each liquid jet head is denoted by a and an elapsed period having elapsed from the detection of the floating of the sheet 36 is denoted by t, the magnitude $|u_2|$ of the speed $u_2$ of each liquid jet head, which is subjected to the acceleration/deceleration operation, in the acceleration period is represented by Equation 4 to be described below.

$$|u_2|=|a|\times t \qquad \text{Equation 4}$$

The unit of $u_2$ is mm/s. The acceleration period is a period between the movement start timing of each liquid jet head and a timing when the magnitude $|u_2|$ of the speed of each liquid jet head reaches the maximum value $|u_{2max}|$.

The magnitude $|u_2|$ of the speed of each liquid jet head, which is subjected to the acceleration/deceleration operation, in the deceleration period is represented by Equation 5 to be described below.

$$|u_2|=|u_{2max}|-|a|\times t \qquad \text{Equation 5}$$

The unit of $u_2$ is mm/s. The deceleration period is a period between a timing when the magnitude $|u_2|$ of the speed of each liquid jet head reaches the maximum value $|u_{2max}|$ and a timing when each liquid jet head stops.

The inclination of each straight line, which represents the magnitude of the speed of each liquid jet head shown in FIG. 14, means the magnitude a of the acceleration a of each liquid jet head. The magnitude |a| of the acceleration a can be made relatively smaller in the case of the liquid jet head that is disposed at a position closer to the downstream side in the sheet transport direction.

The area of a portion, which is surrounded by the straight line representing the magnitude $|u_2|$ of the speed $u_2$ of each liquid jet head shown in FIG. 14, means a distance H between the retreat position and the jet position of each liquid jet head, and the value thereof is constant. The magnitude $|u_{2max}|$ of the maximum speed $u_{2max}$ of each liquid jet head is represented by Equation 6 to be described below.

$$|u_{2max}|=2\times H/t_{SH} \qquad \text{Equation 6}$$

Since the value of the period $t_{SH}$ is relatively larger in the case of the liquid jet head that is disposed at a position closer to the downstream side in the sheet transport direction, the magnitude $|u_{2max}|$ of the maximum speed $u_{2max}$ is relatively smaller in the case of the liquid jet head that is disposed at a position closer to the downstream side in the sheet transport direction.

In regard to the liquid jet heads 56C, 56M, 56Y, and 56K. As shown in FIG. 14, the movement of the liquid jet heads 56M, 56Y, and 56K is started during the period in which the liquid jet head 56C is moved.

Then, in the case in which liquid jet heads 56C, 56M, 56Y, and 56K reach the retreat positions, the operations of the liquid jet heads 56C, 56M, 56Y, and 56K are stopped in sequence. The operation of the liquid jet head, which is disposed at a position on the upstream side in the sheet transport direction, is stopped during the operation of the liquid jet head that is disposed at a position on the downstream side in the sheet transport direction.

A timing when an elapsed period is zero in regard to an elapsed period having elapsed from the detection of the floating of a sheet shown in FIG. 14 corresponds to the first timing when the operation of the first head raisin lowering unit is to be started.

Figure 15:
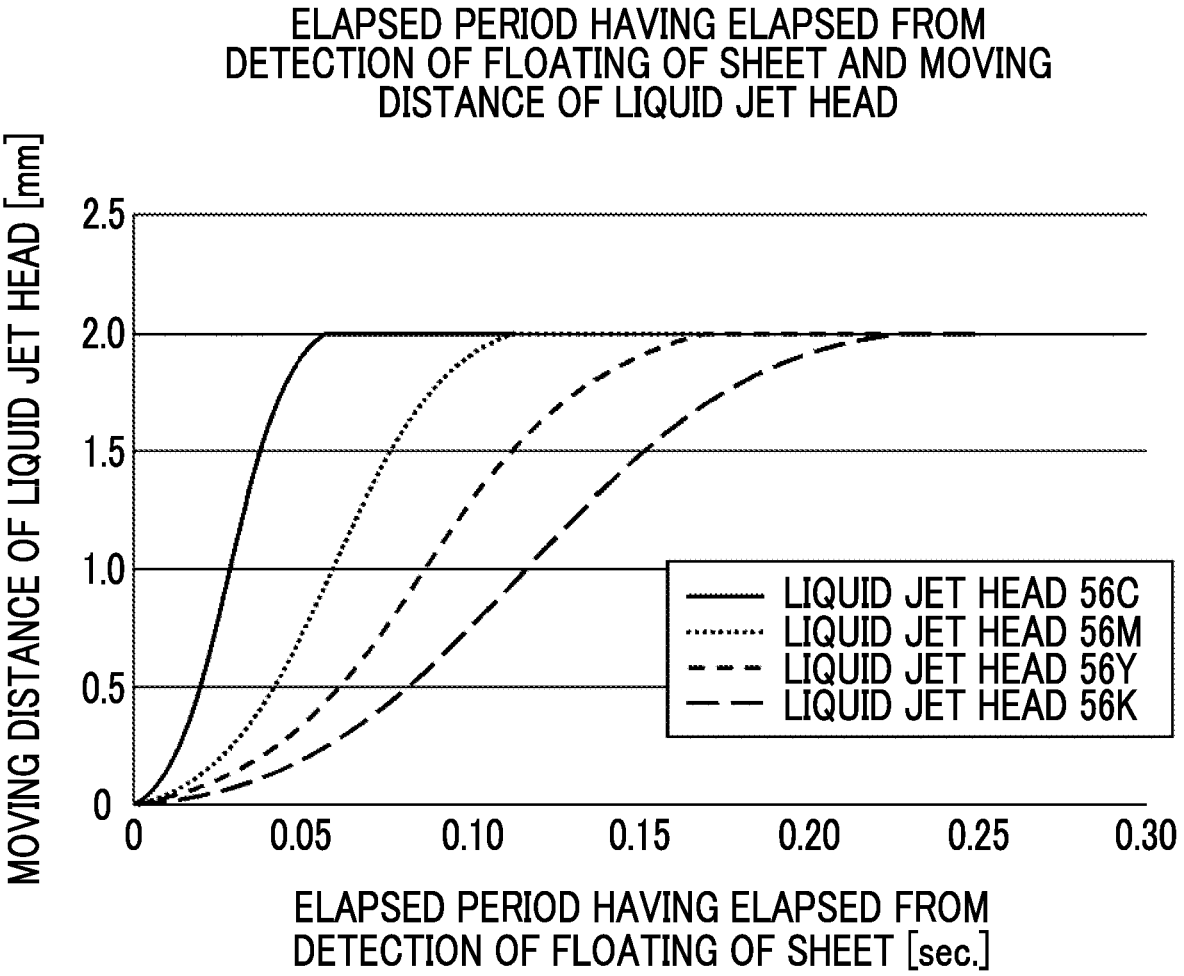
FIG. 15 is a graph showing a relationship between an elapsed period having elapsed from the detection of the floating of a sheet and the moving distance of each liquid jet head in the method of coping with the floating of a sheet according to the second embodiment.

FIG. 15 is a graph showing a relationship between an elapsed period having elapsed from the detection of the floating of a sheet and the moving distance of each liquid jet head in the method of coping with the floating of a sheet according to the second embodiment. A horizontal axis of the graph shown in FIG. 15 represents an elapsed period having elapsed from the detection of the floating of a sheet. The unit of the horizontal axis is second. A vertical axis of the graph shown in FIG. 15 represents the moving distance of each liquid jet head. The unit of the vertical axis is millimeter.

Figure 16:
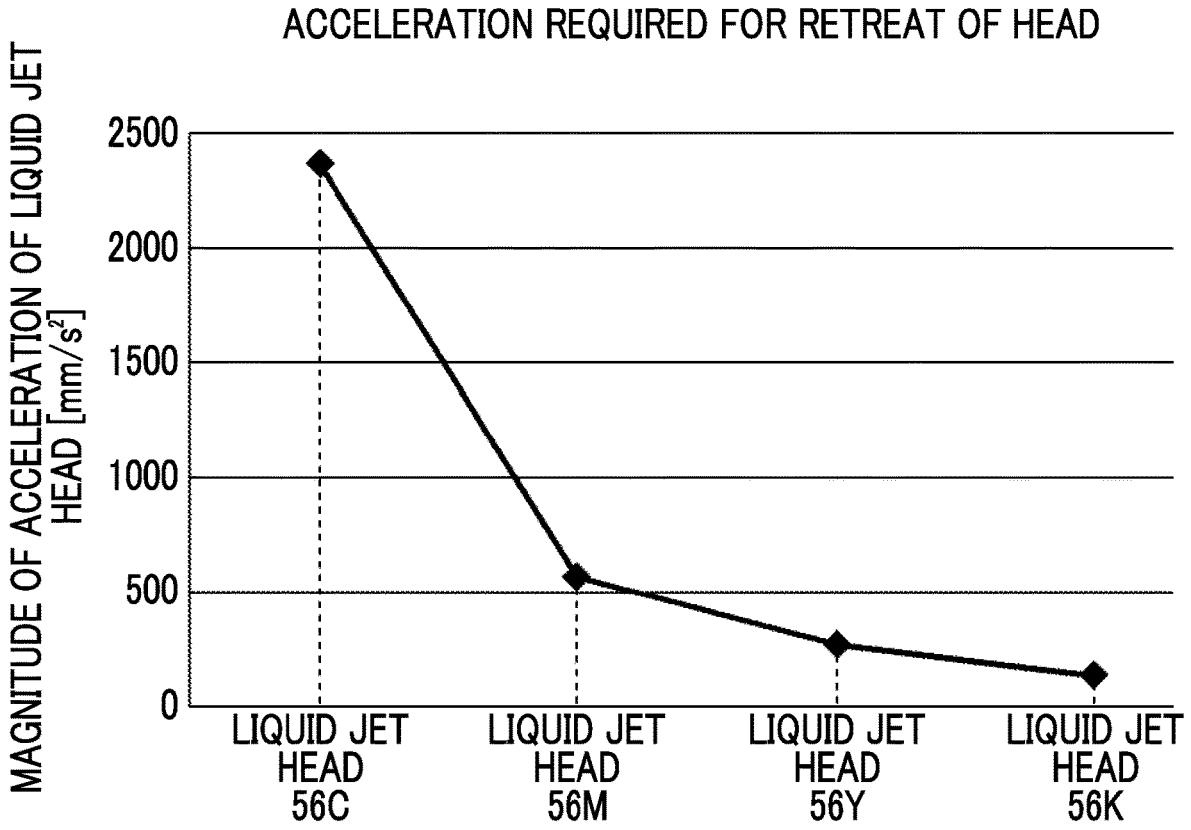
FIG. 16 is a graph showing the magnitude of acceleration required for the retreat of each liquid jet head in the method of coping with the floating of a sheet according to the second embodiment.

FIG. 16 is a graph showing the magnitude of acceleration required for the retreat of each liquid jet head in the method of coping with the floating of a sheet according to the second embodiment. A horizontal axis of the graph shown in FIG. 16 represents the respective liquid jet heads. A vertical axis of the graph shown in FIG. 16 represents the magnitude of the acceleration of each liquid jet head. The unit of the vertical axis is mm/s.

As shown in FIG. 16, the magnitude |a| of the acceleration a, which is obtained in a case in which each liquid jet head is moved to the retreat position from the jet position, can be made relatively smaller in the case of the liquid jet head that is disposed at a position closer to the downstream side in the sheet transport direction.

The magnitude a of the acceleration a of each liquid jet head is represented by Equation 7 to be described below.

$$|a|=4\times H/t_{SH}^2 \qquad \text{Equation 7}$$

Since the value of the period $t_{SH}$ is relatively larger in the case of the liquid jet head that is disposed at a position closer to the downstream side in the sheet transport direction, the magnitude |a| of the acceleration a is relatively smaller in the case of the liquid jet head that is disposed at a position closer to the downstream side in the sheet transport direction. The numerical values of the respective axes of the graphs shown in FIGS. 14 to 16 correspond to Table 2 to be described below.

Table 2 shows specific examples of the magnitudes |a| of the acceleration a of the respective liquid jet heads 56C, 56M, 56Y, and 56K.

TABLE 2

| | LIQUID JET HEAD | | | |
|---|---|---|---|---|
| | 56C | 56M | 56Y | 56K |
| L [mm] | 62 | 124 | 186 | 248 |
| $t_{SH}$ [sec] | 0.058 | 0.117 | 0.175 | 0.234 |
| \|a\| [mm/sec$^2$] | 2338.4 | 584.6 | 259.8 | 146.1 |

Since parameters used for the calculation of the distance L and parameters used for the calculation of the period $t_{SH}$ shown in Table 2 are the same as the parameters used for the calculation of the distance L and parameters used for the calculation of the period $t_{SH}$ shown in Table 1, the description thereof will be omitted.

In the calculation of the magnitude |a| of the acceleration a shown in Table 2, the distance H between the retreat position and the jet position of each liquid jet head is set to 2.0 mm.

Figure 17:
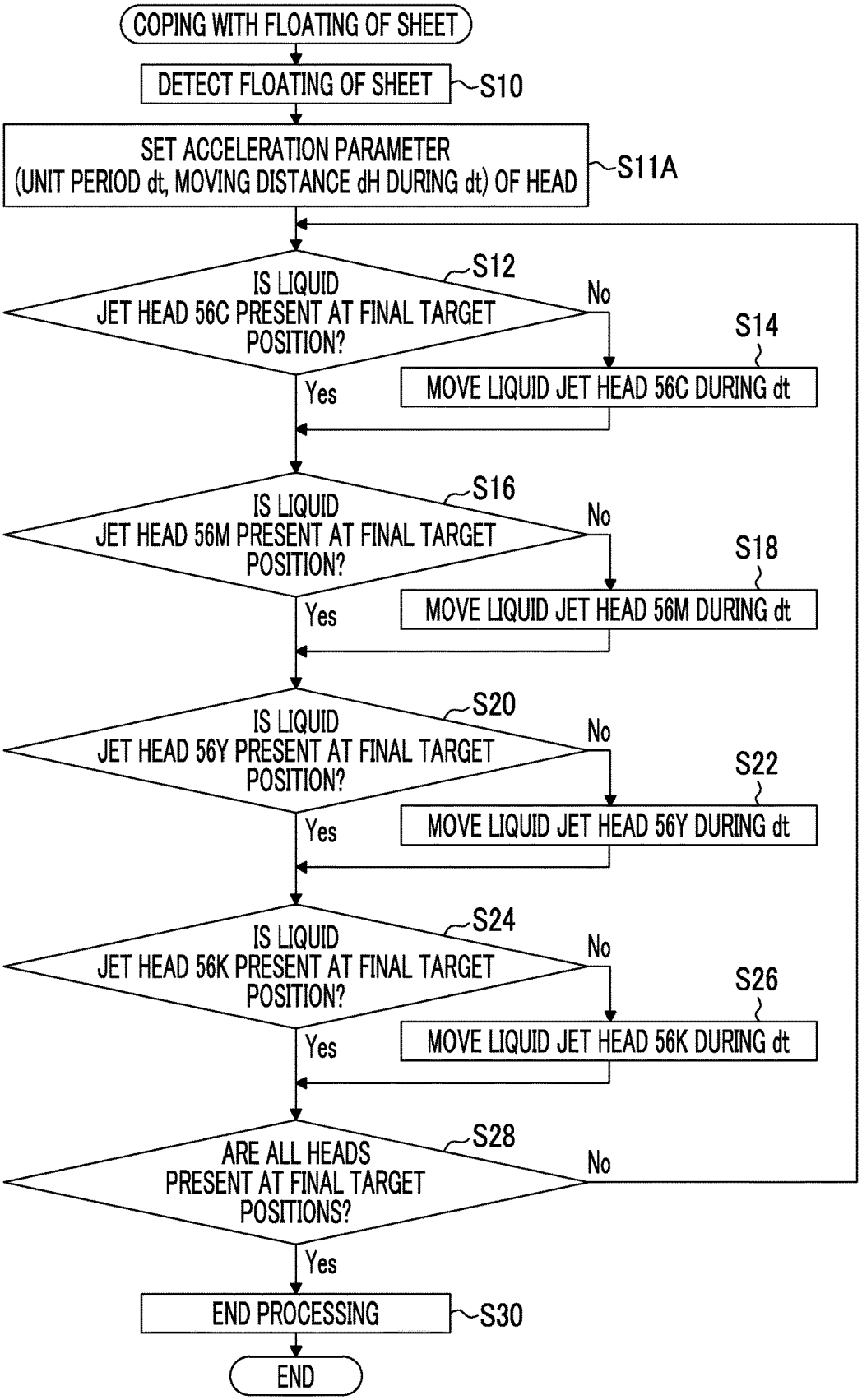
FIG. 17 is a flowchart showing a procedure of the method of coping with the floating of a sheet according to the second embodiment.

Procedure of Method of Coping with Floating of Sheet According to Second Embodiment FIG. 17 is a flowchart showing a procedure of the method of coping with the floating of a sheet according to the second embodiment. In the flowchart shown in FIG. 17, the speed parameter-setting step S11 of the flowchart shown in FIG. 13 is replaced with an acceleration parameter-setting step S11A shown in FIG. 17.

In the acceleration parameter-setting step S11A shown in FIG. 17, the acceleration parameters of each liquid jet head shown in FIG. 10 are set by the movement parameter setting unit 142 shown in FIG. 9. In this embodiment, the unit period dt and the moving distance dH of each liquid jet head during the unit period dt are set as the acceleration parameters.

The acceleration parameter-setting step S11A shown in FIG. 17 is one aspect of a second movement parameter-setting step of setting a second movement parameter representing the magnitude of the acceleration the second liquid jet head to be moved in a direction having an upward component opposite to the direction of gravity that is smaller than the magnitude of the acceleration of the first liquid jet head.

After the unit period dt and the moving distance dH are set in the acceleration parameter-setting step S11A of FIG. 17, processing proceeds to a first head position-determination step S12.

The unit period dt, which is set in the acceleration parameter-setting step S11A of FIG. 17, is set to the same value for the respective liquid jet heads. The moving distance dH during the unit period dt is set to values different for the respective liquid jet heads. Further, the moving distance di during the unit period dt is set to values different for the unit periods dt.

That is, the moving distance dH during the unit period dt is set to values different for the unit periods dt so as to correspond to the magnitudes of the acceleration of the liquid jet heads. In the acceleration parameter-setting step S11A, at least one of the magnitude of speed or the magnitude of acceleration may be set instead of the unit period dt and the moving distance dH. The average value of the magnitude of the speed of each liquid jet head during a period in which each liquid jet head is moved may be set as the magnitude of speed, or the maximum value of the magnitude of the speed of each liquid jet head during a period in which each liquid jet head is moved may be set as the magnitude of speed.

The acceleration parameter-setting step S11A shown in FIG. 17 may be divided into a first movement parameter-setting step of setting the movement parameters of the first liquid jet head and a second movement parameter-setting step of setting the movement parameters of the second liquid jet head.

Effects of Second Embodiment

Since the acceleration parameters are individually set for the liquid jet heads as the movement parameters in a case in which the floating of a sheet occurs and each liquid jet head is allowed to retreat to the retreat position from the jet position, the same effects as the first embodiment can be obtained.

Further, a change in the back pressure of the liquid jet head, of which the magnitude of the acceleration is set to a relatively small value, is relatively small. Back pressure is pressure that is applied to an ink flow passage formed in the liquid jet head. Back pressure can be adjusted for each head module 200 shown in FIG. 2.

In this case, a change in the meniscus shape of the nozzle portion is relatively small. Further, the entrainment of air bubbles from the nozzle portions is relatively suppressed. As a result, the number of times of dummy jet is reduced. Furthermore, the amount of ink to be consumed in a case in which dummy jet is performed is relatively reduced.

In the case of a flow passage structure where the common circulation flow passage 228 is connected to the nozzle portions 281 through the individual circulation flow passages 226 shown in FIG. 4, a change in pressure occurring in the common circulation flow passage 228 affects the nozzle portions 281 in sequence toward the nozzle portion 281 that is far from the common circulation flow passage 228 from the nozzle portion 281 that is close to the common circulation flow passage 228.

In a case in which the acceleration of each liquid jet head is relatively high, the number of nozzle portions 281, which are affected by a change in pressure occurring in the common circulation flow passage 228 due to a change in back pressure, is increased. Since the acceleration of each liquid jet head is relatively low, the number of nozzle portions 281, which are affected by a change in pressure occurring in the common circulation flow passage 228 due to a change in back pressure, is reduced. As a result, the number of times of dummy jet can be reduced.

[Description of Delay in Operation Start Timing of Liquid Jet Head]

In the method of coping with the floating of a sheet according to the first and second embodiments, the operation start timing of each liquid jet head is delayed by the unit period dt. On the other hand, the operation start timing of a liquid jet head, which is disposed at a position on the downstream side in the sheet transport direction, may be delayed from the operation start timing of a liquid jet head that is disposed at a position on the downstream side in the sheet transport direction.

The allowable range of a delay period of the first embodiment will be described bellow. The magnitude $|u_{1min}|$ of the minimum value $u_{1min}$ of the speed $u_1$ of each liquid jet head, which is obtained in a case in which each liquid jet head is moved to the retreat position from the jet position, is represented by Equation 8 to be described below.

$$|u_{1min}|=H/(t_{SH}-t_{del}) \quad \text{Equation 8}$$

The liquid jet head, which is disposed at a position relatively close to the upstream side in the sheet transport direction, is a first liquid jet head, and the liquid jet head, which is disposed at a position relatively close to the downstream side in the sheet transport direction, is a second liquid jet head. For example, the liquid jet head 56C shown in FIG. 10 is the first liquid jet head and the liquid jet head 56M is the second liquid jet head.

The magnitude of the minimum value $u_{11min}$ of the speed $u_{11}$ of the first liquid jet head, which is obtained in a case in which the first liquid jet head is moved to the retreat position from the jet position, is $|u_{11min}|$. The magnitude of the minimum value $u_{12min}$ of the speed $u_{12}$ of the second liquid jet head, which is obtained in a case in which the second liquid jet head is moved to the retreat position from the jet position, is $|u_{12min}|$.

A condition, which satisfies $|u_{11min}|>|u_{12min}|$, is represented by Equation 9 to be described below.

$$H/(t_{SH}-t_{del1})>H/(t_{SH}-t_{del2}) \quad \text{Equation 9}$$

The period $t_{SH1}$ of Equation 9 is a period between a timing when the floating of a sheet 36 is detected in the first liquid jet head and a timing when the sheet 36 reaches the liquid jet region of the first liquid jet head.

The period $t_{SH2}$ of Equation 9 is a period between a timing when the floating of the sheet 36 is detected in the second liquid jet head and a timing when the sheet 36 reaches the liquid jet region of the second liquid jet head.

The delay period $t_{del1}$ of Equation 9 is a delay period of the movement start timing of the first liquid jet head that is to be moved to the retreat position from the jet position. The delay period $t_{del1}$ of the first liquid jet head is zero.

The delay period $t_{del2}$ of Equation 9 is a delay period of the movement start timing of the second liquid jet head that is to be moved to the retreat position from the jet position. The distances H between the retreat positions and the jet positions of the respective liquid jet heads have the same value. The condition, which satisfies $|u_{11min}|>|u_{12min}|$, is obtained from Equation 9 and is represented by Equation 10 to be described below.

$$t_{SH2}-t_{SH1}>t_{del2} \quad \text{Equation 10}$$

The magnitudes of the minimum values of the speeds of the liquid jet heads 56C, 56M, 56Y, and 56K shown in FIG. 10, which are obtained in a case in which each of the liquid jet heads is moved to the retreat position from the jet position, are $|u_{1Cmin}|$, $|u_{1Mmin}|$, $|u_{1Ymin}|$, and $|u_{1Kmin}|$, respectively.

The specific examples of the delay periods of the liquid jet heads 56C, 56M, 56Y, and 56K, which are calculated using Equation 10 in a case in which the minimum values $|u_{1Cmin}|$, $|u_{1Mmin}|$, $|u_{1Ymin}|$, and $|u_{1Kmin}|$ of the speeds of the respective liquid jet heads have the same value, are shown in Table 3.

TABLE 3

| | LIQUID JET HEAD | | | |
|---|---|---|---|---|
| | 56C | 56M | 56Y | 56K |
| $t_{del}$ [sec] | 0 | 0.058 | 0.117 | 0.175 |

The delay periods $t_{del}$ of the liquid jet heads 56M, 56Y, and 56K shown in Table 3 are periods from the movement start timing of the liquid jet head 56C.

Since parameters, which are used for the calculation of the delay periods $t_{del}$ shown in Table 3, are the same as the parameters used for the calculation of the distances L or the like shown in Table 1, the description thereof will be omitted here.

Figure 18:
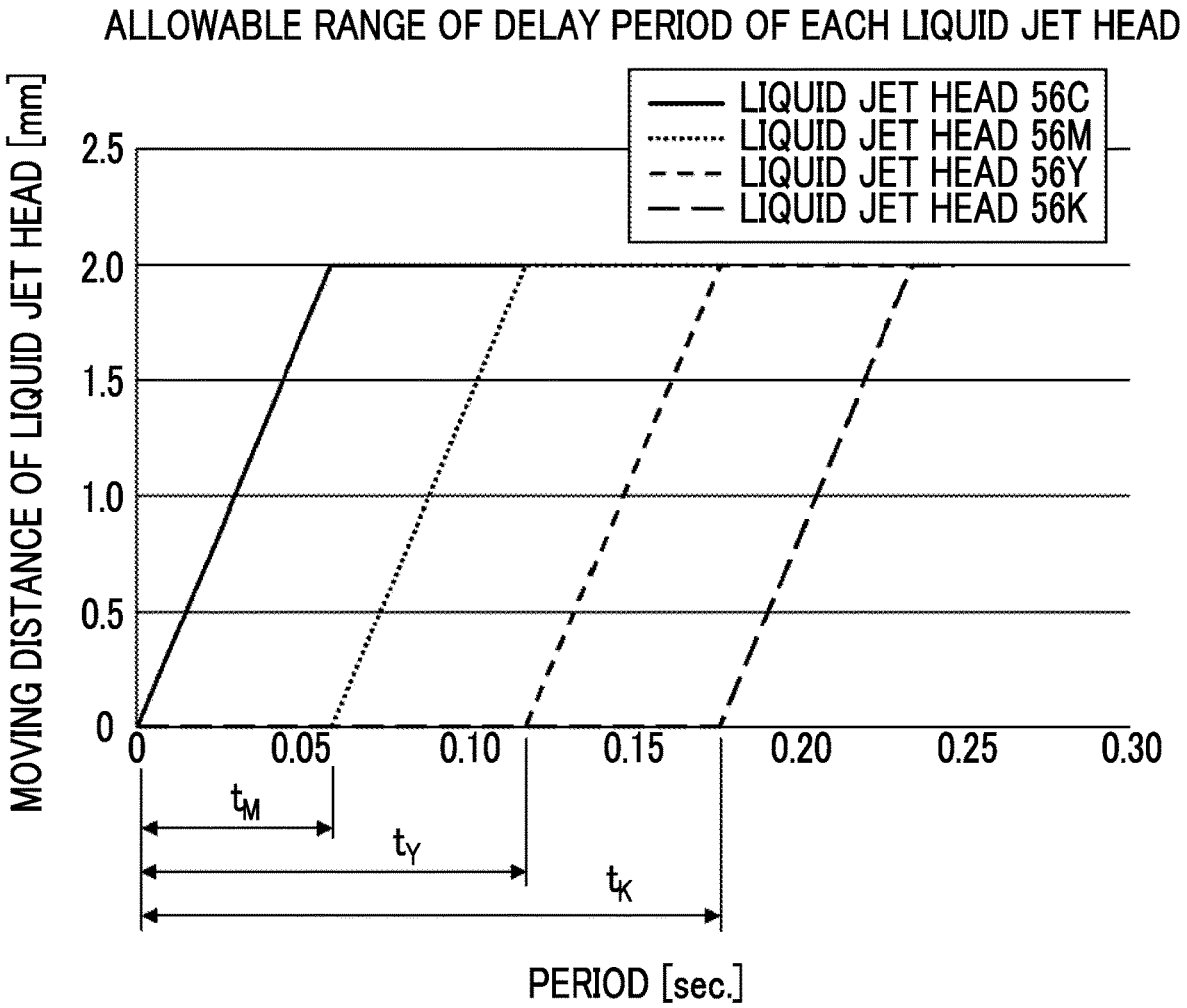
FIG. 18 is a graph showing the allowable range of a delay period of each liquid jet head.

FIG. 18 is a graph showing the allowable range of the delay period of each liquid jet head. A horizontal axis of the graph shown in FIG. 18 represents a period elapsed from the movement start timing of the liquid jet head 56C. The unit of the horizontal axis is second. In FIG. 18, the delay period of the liquid jet head 56C is set to 0 sec. A vertical axis of the graph shown in FIG. 18 represents the moving distance of each liquid jet head that is moved from the liquid jet position in a direction opposite to the direction of gravity. The unit of the vertical axis is millimeter.

A period, which is denoted by reference numeral $t_M$ shown in FIG. 18, is the maximum value of the allowable delay period of the liquid jet head 56M. A period, which is denoted by reference numeral $t_Y$, is the maximum value of the allowable delay period of the liquid jet head 56Y. A period, which is denoted by reference numeral $t_K$, is the maximum value of the allowable delay period of the liquid jet head 56K.

The inclination of each straight line, which represents the moving distance of each liquid jet head during the period, means the speed of each liquid jet head. In a case in which the delay period of each liquid jet head is less than the maximum value of the allowable delay period, the inclination of the straight line, which represents the moving distance of each liquid jet head during the period, is relatively small. That is, in a case in which the delay period of each liquid jet head is made relatively short, the speed of each liquid jet head can be made relatively low.

Figure 19:
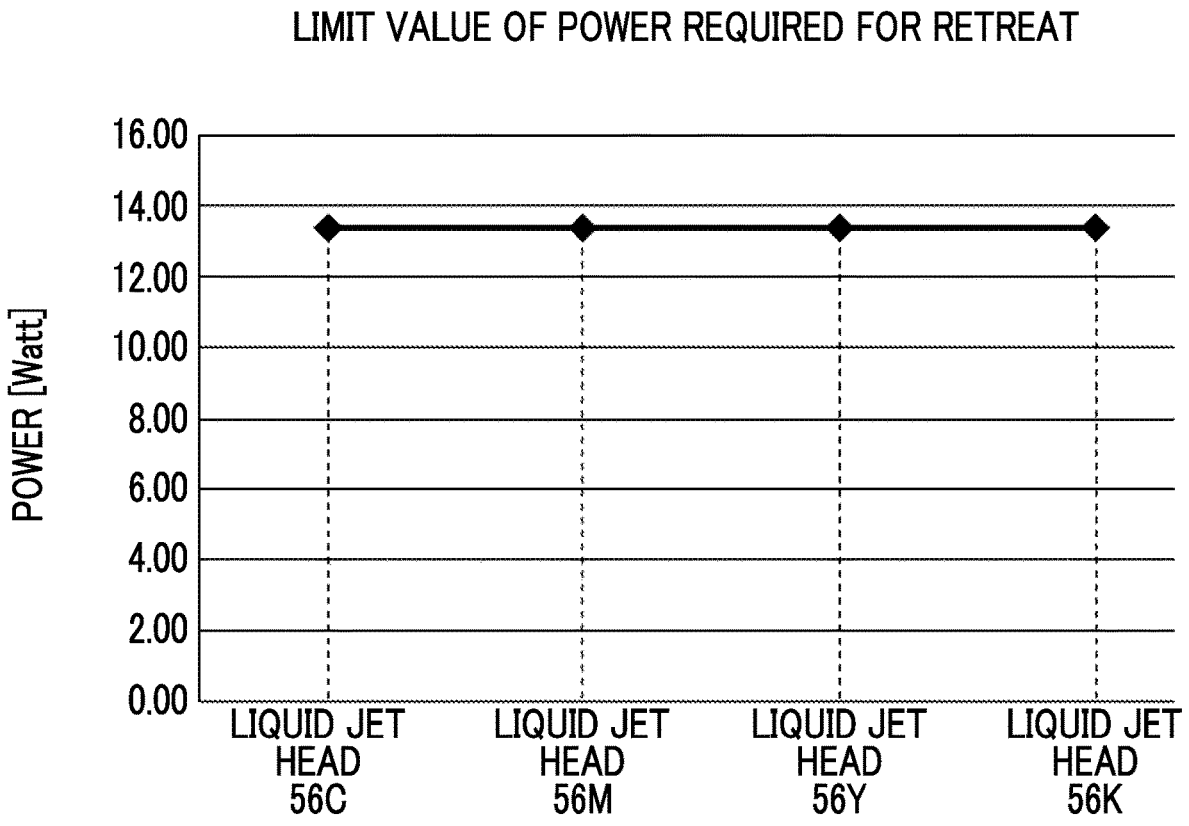
FIG. 19 is a graph showing the boundary of the allowable range of power required for the retreat of each liquid jet head.

FIG. 19 is a graph showing the limit value of power required for the retreat of each liquid jet head. A horizontal axis of the graph shown in FIG. 19 represents the respective liquid jet heads. A vertical axis of the graph shown in FIG. 19 represents the power of each liquid jet head. The unit of the vertical axis is watt.

The limit value of the power required for the retreat of each liquid jet head shown in FIG. 19 is calculated from the speed of each liquid jet head shown in FIG. 18. The allowable range of power required for the retreat of each liquid jet head is less than the limit value of power required for the retreat of each liquid jet head.

In a case in which the power of the liquid jet heads 56C, 56M, 56Y, and 56K is denoted by $WA_C$, $WA_M$, $WA_Y$, and $WA_K$, respectively, and "$WA_C>WA_M$", "$WA_C>WA_Y$", and "$WA_C>WA_K$", are satisfied, "$WA_M=WA_Y=WA_K$" may be satisfied.

In the specific examples shown in Table 3, a delay period between the liquid jet heads 56C and 56M may be shorter than 0.058 sec. Considering all conditions, such as the speeds, the moving distances, and the like of the respective liquid jet heads, the delay period between the liquid jet heads 56C and 56M may be 0.057 sec that is shorter than 0.058 sec by 0.001 sec.

A delay period, which is allowable for the movement start timing of each liquid jet head, has been described here using the first embodiment as an example, but the delay period, which is allowable for the movement start timing of each liquid jet head, described here can also be applied to the second embodiment.

A second timing is a timing when the delay period has elapsed from the first timing. The delay period is shorter than a period between a timing when the floating of a medium is detected and a timing when the medium of which the floating is detected reaches the first liquid jet region.

[Description of Return Processing]

After the sheet 36 of which the floating is detected passes through the liquid jet region of each liquid jet head, the return processing for moving each liquid jet head to the jet position from the retreat position is performed. The liquid jet region of each liquid jet head mentioned here corresponds to the position of the downstream end of the liquid jet region in the sheet transport direction.

The return processing may be started at a separate timing for each liquid jet head. The return processing for a plurality of liquid jet heads may be started at the same timing. Specific examples of the return processing will be described below.

First Specific Example

Each liquid jet head is moved to the jet position from the retreat position. After that, the dummy jet of each liquid jet head is performed. The dummy jet of each liquid jet head may be performed on the sheet 36 that is supported by the drawing drum 52. The dummy jet of each liquid jet head may be performed in a dummy jet region that is formed on the drawing drum 52. After the dummy jet of all the liquid jet heads is performed, a state in which drawing can be performed is made.

Second Specific Example

The cap 510 shown in FIG. 8 may be used for the dummy jet of each liquid jet head. Each liquid jet head is moved to a position above the cap 510. The cap 510 is made to be in contact with the liquid jet surface of each liquid jet head.

The dummy jet of each liquid jet head is performed on the cap 510. After the dummy jet of each liquid jet head is performed, each liquid jet head is moved to a drawing position. After all the liquid jet heads are moved to the drawing positions, a state in which drawing can be performed is made.

The ink jet recording apparatus 10 comprising four liquid jet heads has been exemplified in the first and second embodiments, but the number of liquid jet heads may be two or more.

An aspect where each liquid jet head is moved in an oblique direction crossing the direction of gravity so as to retreat has been exemplified in the first and second embodiments, but each liquid jet head may be moved in a direction opposite to the direction of gravity so as to retreat.

Transport using the transport drum has been exemplified in FIG. 1, but a transport mechanism, such as a transport belt or a platen, may be used to transport a medium in a horizontal direction or a direction crossing the horizontal direction.

The embodiments of the invention described above can be properly subjected to the modification, addition, and deletion of components without departing from the scope of the invention. The invention is not limited to the above-mentioned embodiments, and can be modified in various ways by those skilled in the art without departing from the scope of the invention.

EXPLANATION OF REFERENCES

10: ink jet recording apparatus
12: sheet feed unit
14: treatment liquid-application section

16: treatment liquid-drying processing section
18: drawing unit
20: ink-drying processing section
21: drying processing device
22: sheet transport member
24: sheet discharge unit
30: stocker
32: sheet feed sensor
34: feeder board
36: sheet
36A: first surface
42: treatment liquid drum
42A, 46A, 52A, 402C, 402D, 406A: rotating shaft
42B, 46B, 52B: outer peripheral surface
44: treatment liquid-application device
44A: application roller
44B: measurement roller
44C: treatment liquid container
46: treatment liquid-drying processing drum
48: transport guide
50: treatment liquid-drying processing device
52: drawing drum
52C: gripper
52D: recessed portion
55: sheet floating sensor
56, 56C, 56M, 56Y, 56K: liquid jet head
56A: one end
56B, 56E: bearing
56D: the other end
57C, 57M, 57Y, 57K: liquid jet region
58: in-line sensor
100: system controller
102: communication unit
103: host computer
104: image memory
110: sheet teed control unit
112: transport control unit
114: transport unit
116: treatment liquid-application control unit
117: treatment liquid-drying processing control unit
118: drawing control unit
120: head movement control unit
122: ink-drying processing control unit
124: sheet discharge control unit
126: maintenance control unit
127: head maintenance section
130: operation unit
132: display section
134: parameter storage unit
136: program storage unit
140: sheet floating detection unit
142: movement parameter setting unit
200: head module
210: flow passage structure
214: ink supply passage
216: individual supply passage
218: pressure chamber
220: nozzle communication passage
226: individual circulation flow passage
228: common circulation flow passage
230: piezoelectric element
231: piezoelectric layer
232: ink supply chamber
236: ink circulation chamber
252: supply-side individual flow passage
256: collection-side individual flow passage
264: upper electrode
265: lower electrode
266: vibrating plate
267: adhesive layer
275: nozzle plate
277: liquid jet surface
280: nozzle opening
280A: projection nozzle array
281: nozzle portion
400: head raising/lowering unit
402A, 402B: eccentric cam
404: cam shaft
406: motor
410: motor driver
412: power source
500: horizontal head moving unit
502: ink discharge unit
504: wiping unit
510: cap
512: discharge flow passage
514: suction pump
516: discharge tank
520: wiping web
522: case
530, 532: moving direction
S10 to S30: respective steps of method of coping with floating of sheet

What is claimed is:

1. A liquid jetting apparatus comprising:

a medium transport unit that includes a medium support surface supporting a sheet-like medium and transports the medium along a medium transport direction;

a medium floating detection unit that detects floating of the medium transported by the medium transport unit;

a first liquid jet head that is disposed at a position on a downstream side of the medium floating detection unit in the medium transport direction and jets liquid onto the medium transported by the medium transport unit;

a second liquid jet head that is disposed at a position on a downstream side of the first liquid jet head in the medium transport direction and jets liquid onto the medium transported by the medium transport unit;

a first head raising/lowering unit that moves the first liquid jet head in a direction having an upward component opposite to a direction of gravity or a direction having a component parallel to the direction of gravity;

a first movement parameter setting unit that sets at least one of a first movement parameter representing a magnitude of speed of the first liquid jet head moved by the first head raising/lowering unit or a first movement parameter representing a magnitude of acceleration of the first liquid jet head moved by the first head raising/lowering unit;

a first head raising/lowering control unit that controls an operation of the first head raising/lowering unit using the first movement parameter set by the first movement parameter setting unit;

a second head raising/lowering unit that moves the second liquid jet head in a direction having an upward component opposite to the direction of gravity or a direction having a component parallel to the direction of gravity;

a second movement parameter setting unit that sets at least one of a second movement parameter representing a magnitude of speed of the second liquid jet head moved by the second head raising/lowering unit, which is smaller than the magnitude of the speed of the first liquid jet head, or a second movement parameter representing a magnitude of acceleration of the second liquid jet head moved by the second head raising/lowering unit, which is smaller than the magnitude of the acceleration of the first liquid jet head, so as to correspond to the first movement parameter set by the first movement parameter setting unit; and a second head raising/lowering control unit that controls an operation of the second head raising/lowering unit using the second movement parameter set by the second movement parameter setting unit, wherein the first head raising/lowering control unit starts an operation of the first head raising/lowering unit at a first timing to move the first liquid jet head to a first retreat position from a first jet position at which liquid is to be jet from the first liquid jet head, in a case in which the floating of the medium is detected by the medium floating detection unit, and the second head raising/lowering control unit starts an operation of the second head raising/lowering unit at the same timing as the first timing, to move the second liquid jet head to a second retreat position from a second jet position at which liquid is to be jet from the second liquid jet head, in a case in which the floating of the medium is detected by the medium floating detection unit.

2. The liquid jetting apparatus according to claim 1, wherein the second head raising/lowering control unit starts the operation of the second head raising/lowering unit at the same timing as the first timing.

3. The liquid jetting apparatus according to claim 1, wherein the first movement parameter setting unit sets a unit period, which is divided from a period between the timing when the floating of the medium is detected by the medium floating detection unit and a timing when the medium of which the floating is detected reaches a first liquid jet region that is positioned on a transport path of the medium and is the region where liquid is to be jet from the first liquid jet head, and a moving distance of the first liquid jet head during the unit period, as the first movement parameter representing the magnitude of the speed of the first liquid jet head, and the second movement parameter setting unit sets the unit period and a moving distance of the second liquid jet head during the unit period, which is shorter than the moving distance of the first liquid jet head during the unit period, as the second movement parameter representing the magnitude of the speed of the second liquid jet head.

4. The liquid jetting apparatus according to claim 3, wherein the first head raising/lowering control unit allows the first head raising/lowering unit to be operated to intermittently operate the first liquid jet head for each unit period, and the second head raising/lowering control unit allows the second head raising/lowering unit to be operated to intermittently operate the second liquid jet head for each unit period in a non-operation period of the first liquid jet head.

5. The liquid jetting apparatus according to claim 1, wherein the first movement parameter setting unit sets a unit period, which is divided from a period between the timing when the floating of the medium is detected by the medium floating detection unit and the timing when the medium of which the floating is detected reaches a first liquid jet region that is positioned on a transport path of the medium and is the region where liquid is to be jet from the first liquid jet head, and a moving distance of the first liquid jet head during the unit period, which is different for each unit period, as the first movement parameter representing the magnitude of the acceleration of the first liquid jet head, and the second movement parameter setting unit sets the unit period and a moving distance of the second liquid jet head during the unit period, which is shorter than the moving distance of the first liquid jet head during the unit period and is different for each unit period, as the second movement parameter representing the magnitude of the acceleration of the second liquid jet head.

6. The liquid jetting apparatus according to claim 5, wherein the first head raising/lowering control unit allows the first head raising/lowering unit to be operated to intermittently operate the first liquid jet head for each unit period, and the second head raising/lowering control unit allows the second head raising/lowering unit to be operated to intermittently operate the second liquid jet head for each unit period in a non-operation period of the first liquid jet head.

7. The liquid jetting apparatus according to claim 1, wherein in a case in which the first head raising/lowering control unit allows the first head raising/lowering unit to be operated to move the first liquid jet head from the first retreat position to the first jet position that is a position where liquid is to be jet from the first liquid jet head, the first head raising/lowering control unit starts to move the first liquid jet head to the first jet position from the first retreat position at a timing earlier than a timing when the second liquid jet head starts to be moved from the second retreat position to the second jet position that is a position where liquid is to be jet from the second liquid jet head.

8. The liquid jetting apparatus according to claim 1, wherein in a case in which the first head raising/lowering control unit allows the first head raising/lowering unit to be operated to move the first liquid jet head from the first retreat position to the first jet position that is a position where liquid is to be jet from the first liquid jet head, the first head raising/lowering control unit starts to move the first liquid jet head to the first jet position from the first retreat position at the same timing as a timing when the second liquid jet head starts to be moved from the second retreat position to the second jet position that is a position where liquid is to be jet from the second liquid jet head.

9. The liquid jetting apparatus according to claim 1, further comprising:

a first preliminary jet unit that performs preliminary jet of the first liquid jet head when the first liquid jet head is moved to the first jet position from the first retreat position by the first head raising/lowering unit or after the first liquid jet head is moved to the first jet position from the first retreat position by the first head raising/lowering unit; and a second preliminary jet unit that performs preliminary jet of the second liquid jet head when the second liquid jet head is moved to the second jet position from the second retreat position by the second head raising/lowering unit or after the second liquid jet head is moved to the second jet position from the second retreat position by the second head raising/lowering unit.

10. The liquid jetting apparatus according to claim 1, wherein each of the first liquid jet head and the second liquid jet head has a structure in which a plurality of jetting elements are arranged over a length equal to or longer than an entire length of the medium in a direction orthogonal to the medium transport direction.

11. The liquid jetting apparatus according to claim 1, wherein the first liquid jet head jets ink of which a color is different from a color of ink to be jet from the second liquid jet head.

12. The liquid jetting apparatus according to claim 1, wherein each of the first retreat position and the second retreat position has a distance from the medium support surface that exceeds a maximum value of a length of the medium, of which the floating is detected by the medium floating detection unit, from the medium support surface.

13. The liquid jetting apparatus according to claim 1, wherein the second retreat position has a distance from the medium support surface that is the same as a distance between the first retreat position and the medium support surface.

14. A method of coping with floating of a medium for a liquid jetting apparatus that includes a first liquid jet head jetting liquid onto a sheet-like medium transported along a medium transport direction and a second liquid jet head disposed at a position on a downstream side of the first liquid jet head in the medium transport direction, the method comprising:

a medium floating detection step of detecting floating of the sheet-like medium that is supported by a medium support surface and transported along the medium transport direction;

a first movement parameter-setting step of setting at least one of a first movement parameter that represents a magnitude of speed of the first liquid jet head moved in a direction having an upward component opposite to a direction of gravity or a first movement parameter that represents a magnitude of acceleration of the first liquid jet head moved in the direction having the upward component opposite to the direction of gravity after the floating of the medium is detected in the medium floating detection step;

a second movement parameter-setting step of setting at least one of a second movement parameter that represents a magnitude of speed of the second liquid jet head in the direction having the upward component opposite to the direction of gravity, which is smaller than the magnitude of the speed of the first liquid jet head, or a second movement parameter that represents a magnitude of acceleration of the second liquid jet head moved in the direction having the upward component opposite to the direction of gravity, which is smaller than the magnitude of the acceleration of the first liquid jet head, so as to correspond to the first movement parameter set in the first movement parameter-setting step after the floating of the medium is detected in the medium floating detection step;

a first head moving step of starting an operation of the first liquid jet head at a first tinning on the basis of the first movement parameter, which is set in the first movement parameter-setting step, to move the first liquid jet head to a first retreat position from a first jet position at which liquid is to be jet from the first liquid jet head, in a case in which the floating of the medium is detected in the medium floating detection step; and a second head moving step of starting an operation of the second liquid jet head at the same timing as the first timing, on the basis of the second movement parameter, which is set in the second movement parameter-setting step, to move the second liquid jet head to a second retreat position from a second jet position at which liquid is to be jet from the second liquid jet head, in a case in which the floating of the medium is detected in the medium floating detection step.

* * * * *